US010466641B2

(12) United States Patent
Nosho et al.

(10) Patent No.: US 10,466,641 B2
(45) Date of Patent: Nov. 5, 2019

(54) IMAGE FORMING UNIT TO SUPPRESS UNEVEN CHARGING

(71) Applicant: CANON KABUSHIKI KAISHA, Tokyo (JP)

(72) Inventors: Hiroaki Nosho, Suntou-gun (JP); Toru Oguma, Mishima (JP); Takatoshi Hamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/979,176

(22) Filed: May 14, 2018

(65) Prior Publication Data

US 2018/0335746 A1 Nov. 22, 2018

(30) Foreign Application Priority Data

May 19, 2017 (JP) ..... 2017-100056

(51) Int. Cl.
*G03G 15/00* (2006.01)
*G03G 15/02* (2006.01)

(52) U.S. Cl.
CPC ..... *G03G 15/757* (2013.01); *G03G 15/0216* (2013.01)

(58) Field of Classification Search
CPC ..... G03G 15/0216
USPC ..... 399/346, 357, 176
See application file for complete search history.

(56) References Cited

U.S. PATENT DOCUMENTS 6,144,819 A * 11/2000 Nishiuwatoko .... G03G 15/0216 361/225
6,704,540 B2 * 3/2004 Maeshima ..... G03G 21/0058 399/357
2018/0364616 A1 * 12/2018 Funada ..... G03G 15/206

FOREIGN PATENT DOCUMENTS

JP 2015-28545 A 2/2015

* cited by examiner

*Primary Examiner* — Walter L Lindsay, Jr.
*Assistant Examiner* — Arlene Heredia
(74) *Attorney, Agent, or Firm* — Canon U.S.A., Inc. IP Division

(57) ABSTRACT

An image forming unit including a photosensitive member including a gear portion on a one end side of the photosensitive member in a rotational axis direction, a roller that comes in contact with the photosensitive member, a bearing member that rotatably supports the roller, and an elastic member that urges the bearing member. In the image forming unit, directions of moments about a rotational axis of the roller acting on the bearing member disposed on the one end side of the photosensitive member in the rotational axis direction are the same in a case in which the roller is rotated and in a case in which the roller is stopped.

7 Claims, 24 Drawing Sheets

IMAGE FORMING UNIT TO SUPPRESS UNEVEN CHARGING

BACKGROUND OF THE INVENTION

Field of the Invention

The present disclosure relates to an image forming unit that forms an image on a recording medium by using an electrophotographic image forming system such as a copier, a printer (an LED printer, a laser beam printer, and the like), a facsimile machine, or a word processor.

Description of the Related Art

In an electrophotographic image forming apparatus (hereinafter, merely referred to as an "image forming apparatus" as well), typically, a drum-type electrophotographic photoconductor, that is, a photosensitive drum, serving as an image bearing member is uniformly charged. Subsequently, an electrostatic latent image (an electrostatic image) is formed on the photosensitive drum by selectively exposing the charged photosensitive drum. Subsequently, the electrostatic latent image formed on the photosensitive drum is developed as a toner image with toner serving as the developer. Subsequently, the toner image formed on the photosensitive drum is transferred on a recording material such as a recording sheet or a plastic sheet and, further, heat and pressure is applied to the toner image transferred on the recording material so as to fix the toner image on the recording material and to perform image recording.

Japanese Patent Laid-Open No. 2015-28545 discloses a configuration in which a charge roller is pressed against a photosensitive drum with an urging member.

As in Japanese Patent Laid-Open No. 2015-28545, in a case in which bearing members of a roller that contacts the photosensitive member are held by guides of the frame in a movable manner, there is a case in which the guides of the frame and the receiving portions of the bearing member are provided with gaps to maintain slidability with the receiving portions. Since the bearing members are movable within the areas that the gaps allow, there is a possibility of the bearing members vibrating inside the areas that the gaps allow during image formation cause the roller to vibrate and, accordingly, bring about an adverse effect on an image.

SUMMARY OF THE INVENTION

According to a first aspect of the disclosure, an image forming unit that forms an image on a recording medium includes a rotatable photosensitive member, a driving member provided on an one end side of the photosensitive member in a rotational axis direction, the driving member transmitting driving force that rotates the photosensitive member, a roller that comes in contact with the photosensitive member and that rotates together with the photosensitive member, a bearing member that rotatably supports the roller, the bearing member disposed on the one end side of the photosensitive member in the rotational axis direction, and an elastic member that urges the bearing member so that the roller comes in contact with the photosensitive member, a first end of the elastic member being supported by the bearing member and a second end of the elastic member opposite to the first end of the elastic member being supported by a seat surface. In the image forming unit, the elastic member is supported by the bearing member and the seat surface so that a direction of a moment about a rotational axis of the roller acting on the bearing member, the moment being created, in a state in which a rotation of the roller is stopped, by receiving force from the elastic member is same as a direction of a moment about the rotational axis of the roller acting on the bearing member, the moment being created, in a state in which the rotor is rotated, by receiving force through the roller.

Further features of the present disclosure will become apparent from the following description of exemplary embodiments with reference to the attached drawings.

DESCRIPTION OF THE EMBODIMENTS

First Exemplary Embodiment

Hereinafter, exemplary embodiments of the present disclosure will be described in detail with reference to the drawings. Note that unless explicitly stated, the functions, the materials, the shapes, and the relative positions of the components of the present disclosure are not limited to those described in the present exemplary embodiment.

Furthermore, a rotational axis direction of a photosensitive member coincides with a longitudinal direction of the photosensitive member. Furthermore, in the longitudinal direction of the photosensitive member, a side on which the photosensitive member receives driving force from an image forming apparatus main body is referred to as a drive side, and a side opposite to the above is referred to as a non-drive side.

Figure 2:
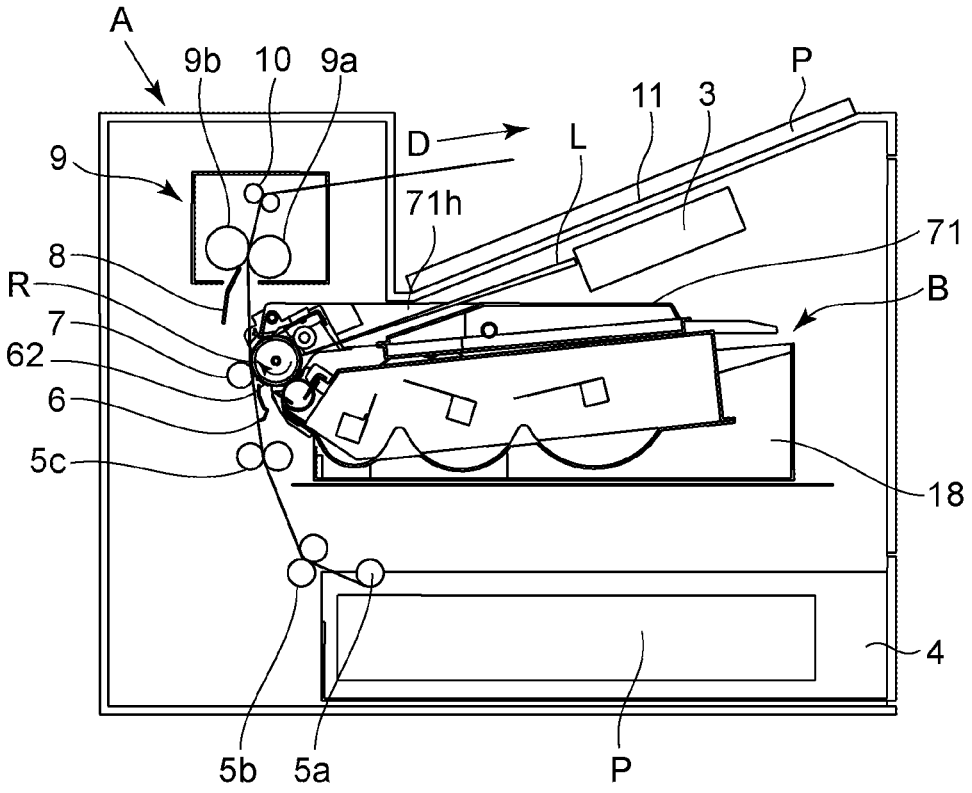
FIG. 2 is a cross-sectional view of an image forming apparatus main body and the process cartridge of the image forming apparatus.
Figure 3:
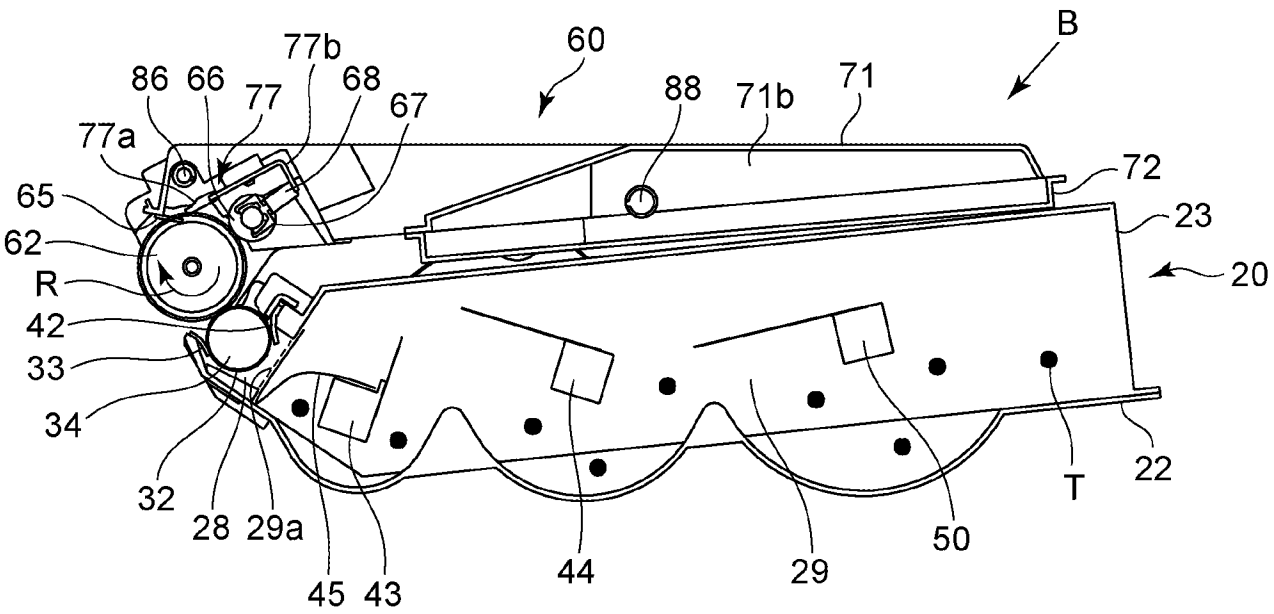
FIG. 3 is a cross-sectional view of the process cartridge.

Referring to FIGS. 2 and 3, an overall configuration and an image forming process will be described. FIG. 2 is a cross-sectional view of an image forming apparatus main body (hereinafter, described as an apparatus main body A) and a process cartridge (hereinafter, described as a cartridge B) of the electrophotographic image forming apparatus that is an exemplary embodiment of the present disclosure. FIG. 3 is a cross-sectional view of the cartridge B. Note that the apparatus main body A is the portion of the electrophotographic image forming apparatus excluding the cartridge B.

Overall Configuration of Electrophotographic Image Forming Apparatus

The electrophotographic image forming apparatus illustrated in FIG. 2 is a laser beam printer employing an electrophotographic technology and is a laser beam printer in which the cartridge B is detachable from the main body A of the apparatus. An exposure device 3 (a laser scanner unit) that forms a latent image on the electrophotographic photosensitive drum 62 of the cartridge B is disposed. Furthermore, a sheet tray 4 that contains recording mediums (hereinafter, described as sheet materials P) that are subjects of image formation is disposed below the cartridge B.

Furthermore, a pickup roller 5*a*, a pair of feed rollers 5*b*, a pair of conveyance rollers 5*c*, a transfer guide 6, a transfer roller 7, a conveyance guide 8, a fixing device 9, a pair of discharge rollers 10, a discharge tray 11, and other members are sequentially disposed in a conveyance direction D of the sheet material P in the main body A of the apparatus. Note that the fixing device 9 includes a heat roller 9*a* and a pressure roller 9*b*.

Image Forming Process

An outline of the image forming process will be described next. Based on a print start signal, the drum 62 serving as an electrophotographic photoconductor is rotationally driven at a predetermined circumferential velocity (processing speed) in an arrow R direction. A charge roller 66, to which a bias voltage has been applied, comes in contact with an outer peripheral surface of the drum 62 and evenly and uniformly charges the outer peripheral surface of the drum 62. The exposure device 3 outputs a laser beam L according to image information. The laser beam L passing through a laser opening 71*h* provided in a cleaning frame 71 of the cartridge B performs scanning exposure on the outer peripheral surface of the drum 62. With the above, an electrostatic latent image according to the image information is formed on the outer peripheral surface of the drum 62.

Meanwhile, as illustrated in FIG. 3, in a developing unit 20 serving as a developing device, toner T inside a toner chamber 29 is stirred and conveyed by rotation of a first conveying member 43, a second conveying member 44, and a third conveying member 50, and is sent out to a toner supply chamber 28. The toner T is carried on a surface of a developing roller 32 with magnetic force of a magnet roller 34 (a stationary magnet). While the toner T is triboelectrically charged, the thickness of the toner T on the peripheral surface of the developing roller 32 is restricted with a developing blade 42. The toner T developed on the drum 62 according to the electrostatic latent image is transferred and is turned into a visible image, that is, a toner image.

Furthermore, as illustrated in FIG. 2, synchronizing with the output timing of the laser beam L, the sheet material P contained in a lower portion of the apparatus main body A is sent out from the sheet tray 4 with the pickup roller 5*a*, the pair of feed rollers 5*b*, and the pair of conveyance rollers 5*c*. Subsequently, the sheet material P passing through the transfer guide 6 is conveyed to a transfer position between the drum 62 and the transfer roller 7. The toner image is sequentially transferred to the sheet material P from the drum 62 at the above transfer position. The sheet material P is a transfer material to which the toner image is transferred from the drum 62.

The sheet material P to which the toner image has been transferred is separated from the drum 62 and is conveyed along the conveyance guide 8 to the fixing device 9. Subsequently, the sheet material P passes through a nip portion between the heat roller 9*a* and the pressure roller 9*b* included in the fixing device 9. A compressing and heat fixing process is performed on the sheet material P at the nip portion and the toner image is fixed to the sheet material P. The sheet material P that has undergone the fixing process of the toner image is conveyed to the pair of discharge rollers 10 and is discharged on the discharge tray 11.

Meanwhile, as illustrated in FIG. 3, the residual toner on the outer peripheral surface of the drum 62 that has performed transferring is removed by a cleaning blade 77 and the drum 62 is used once more in the image forming process. The toner that has been removed from the photosensitive drum 62 is stored in a waste toner chamber 71*b* of a cleaning unit 60.

The charge roller 66, the developing roller 32, the transfer roller 7, the cleaning blade 77 that have been described above are process members that act on the drum 62.

Attaching/detaching of cartridge

Figure 4:
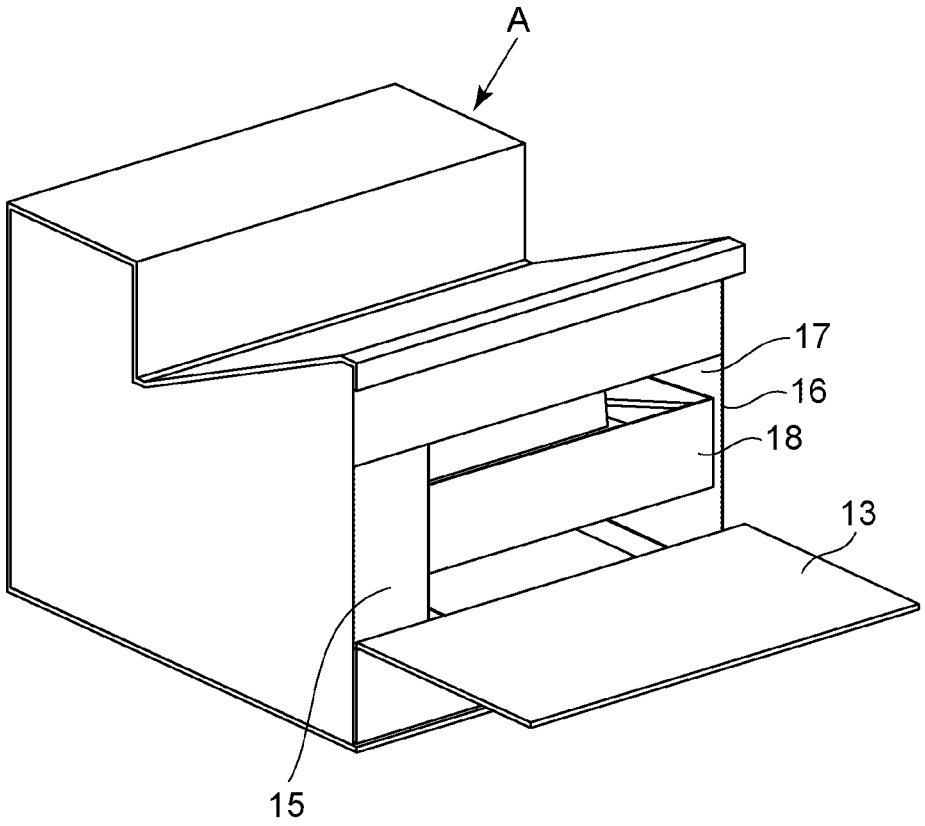
FIG. 4 is a perspective view of an image forming apparatus main body in a state in which an opening/closing door of the image forming apparatus is open.
Figure 5:
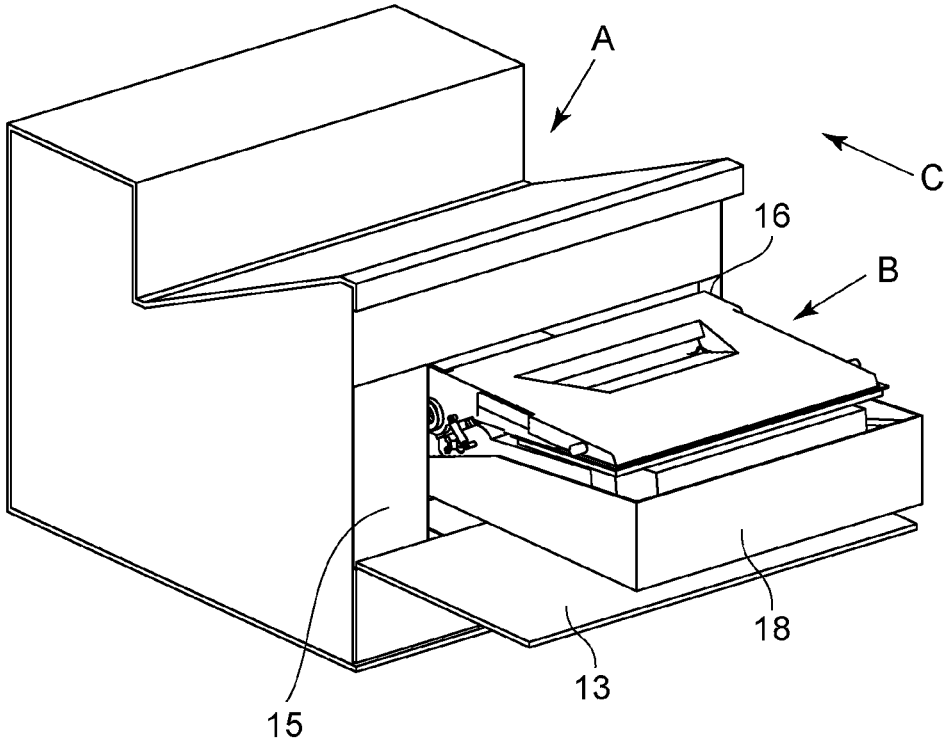
FIG. 5 is a perspective view of the image forming apparatus main body in a state in which the opening/closing door of the image forming apparatus is open and a tray has been drawn out.
Figure 6:
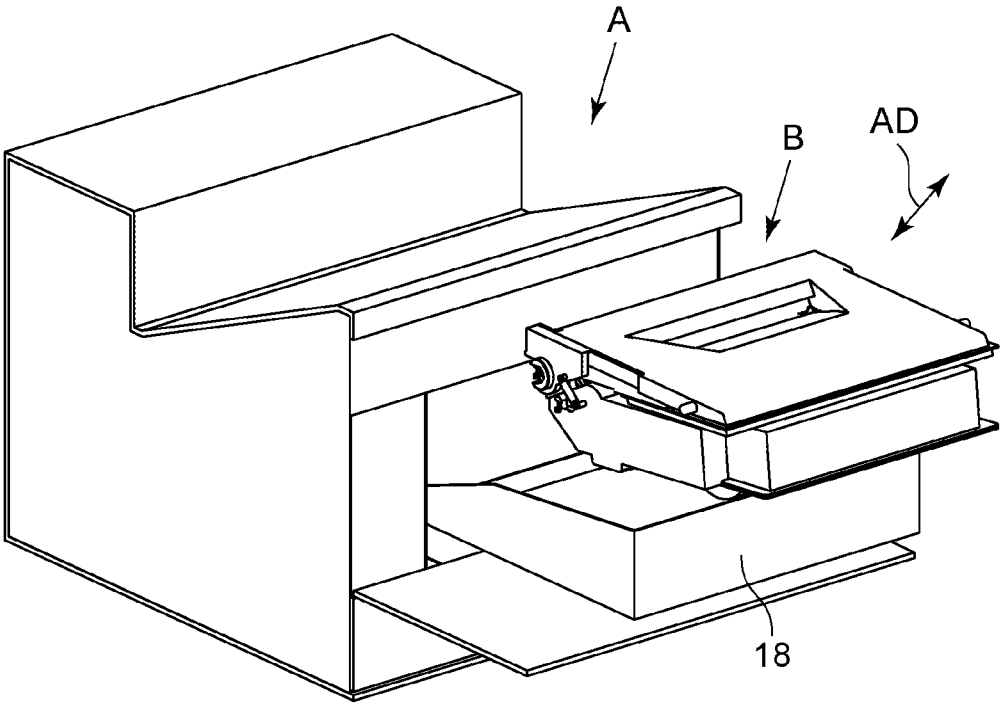
FIG. 6 is a perspective view of the image forming apparatus main body and the process cartridge when the process cartridge is attached/detached from the tray in a state in which the opening/closing door of the image forming apparatus is open and the tray has been drawn out.

Referring next to FIGS. 4, 5, and 6, attaching/detaching of the cartridge B with respect to the apparatus main body A will be described. FIG. 4 is a perspective view of the apparatus main body A in which an opening/closing door 13 is open for attaching and detaching the cartridge B. FIG. 5 is a perspective view of the apparatus main body A and the cartridge B in a state in which the opening/closing door 13 is open and a cartridge tray 18 has been drawn out to attach/detach the cartridge B. FIG. 6 is a perspective view illustrating a state in which the cartridge B has been pulled out while the opening/closing door 13 is open and the tray 18 has been drawn out.

The opening/closing door 13 is pivotably attached to the apparatus main body A, and when the opening/closing door 13 is open, the cartridge insertion port 17 is exposed. The tray 18 for mounting the cartridge B in the apparatus main body A is provided in the cartridge insertion port 17, and when the tray 18 is drawn out to a predetermined position, the cartridge B becomes detachable with respect to the tray 18 in an attaching/detaching direction AD. Furthermore, the cartridge B mounted on the tray 18 is mounted in the apparatus main body A along guide rails (not shown) in an arrow C direction in FIG. 5.

Cartridge Support Configuration

Figure 7:
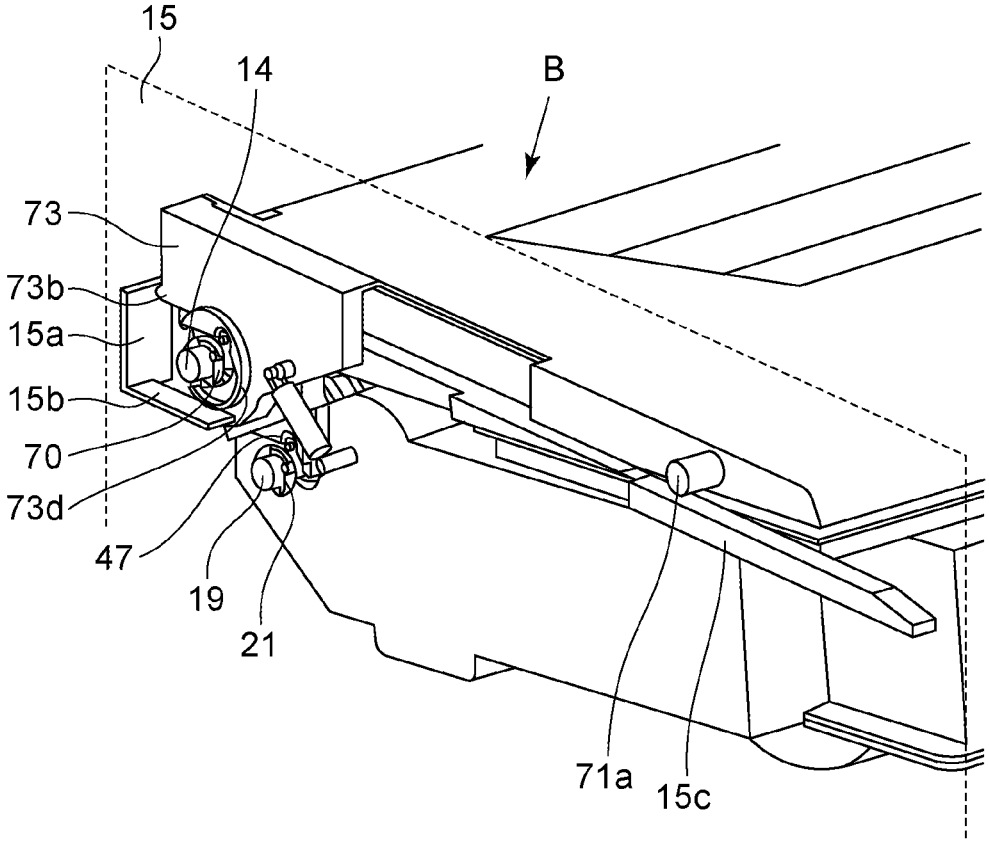
FIG. 7 is a perspective view of a drive side positioning portion of the process cartridge and the image forming apparatus main body in a state in which the process cartridge has been mounted in the image forming apparatus main body.
Figure 8:
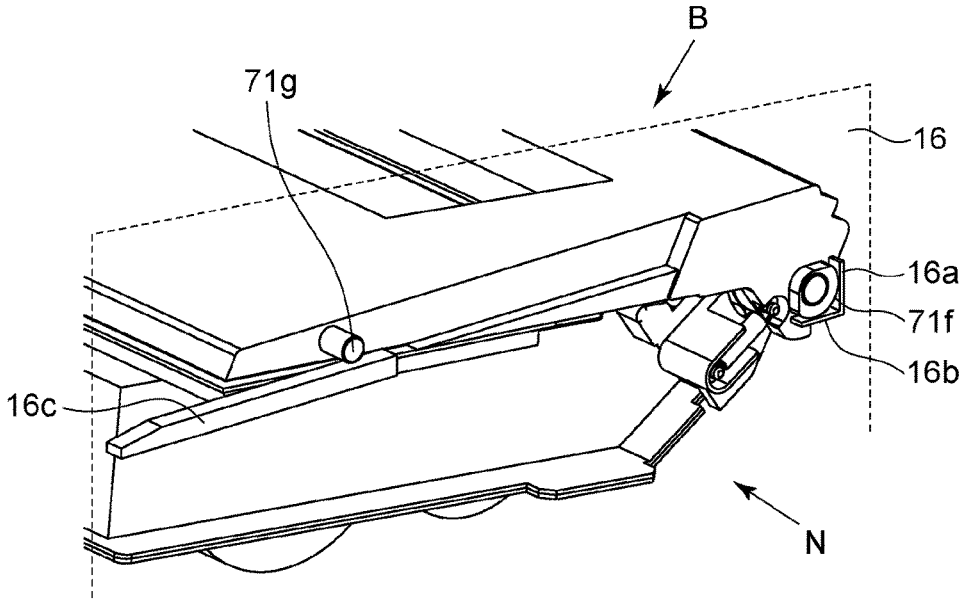
FIG. 8 is a perspective view of a non-drive side positioning portion of the process cartridge and the image forming apparatus main body in a state in which the process cartridge has been mounted in the electrophotographic image forming apparatus main body.

Referring next to FIGS. 1, 4, 7, and 8, a configuration of the apparatus main body A supporting the cartridge B will be described. As illustrated in FIG. 4, the apparatus main body A is provided with a drive side plate 15 and a non-drive side plate 16 that support the cartridge B. Furthermore, as illustrated in FIG. 7, the drive side plate 15 is provided with a drive side first supporting portion 15*a*, a drive side second supporting portion 15*b* and a rotation supporting portion 15*c* of the cartridge B. Furthermore, as illustrated in FIG. 8, the non-drive side plate 16 is provided with a non-drive side first supporting portion 16*a*, a non-drive side second supporting portion 16*b*, and a rotation supporting portion 16*c*.

Meanwhile, a supported portion 73*b*, a supported portion 73*d* of a drum bearing 73, and a drive side boss 71*a*, a non-drive side protrusion 71*f*, and a non-drive side boss 71*g* of the cleaning frame 71 are provided as supported portions of the cartridge B. Furthermore, the supported portion 73*b* is supported by the drive side first supporting portion 15*a*, the supported portion 73*d* is supported by the drive side second supporting portion 15*b*, and the drive side boss 71*a* is supported by the rotation supporting portion 15*c*. Furthermore, the non-drive side protrusion 71*f* is supported by the non-drive side first supporting portion 16*a* and the non-drive side second supporting portion 16*b*, and the non-drive side boss 71*g* is supported by the rotation supporting portion 16*c*. Accordingly, the position of the cartridge B inside the apparatus main body A is determined.

Configuration of Overall Cartridge

Figure 9A:
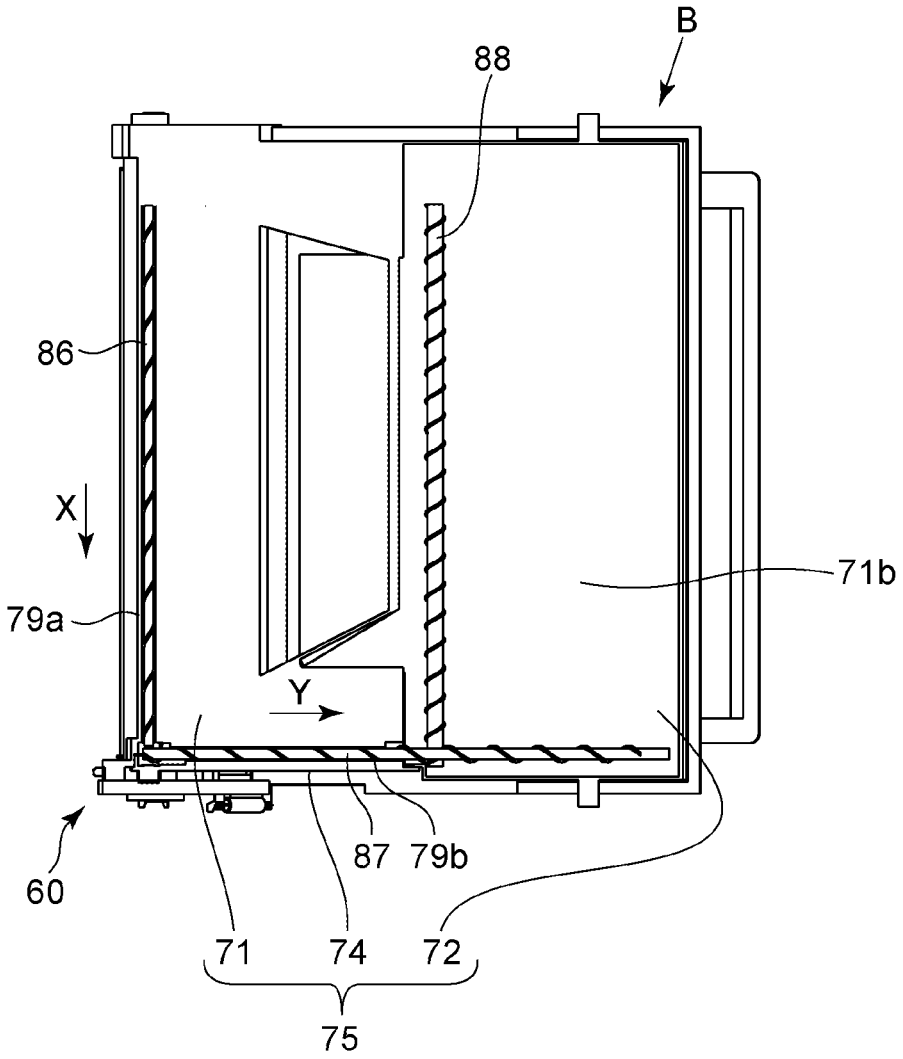
FIGS. 9A and 9B are cross-sectional views of the inside of the cleaner case of the process cartridge.
Figure 9B:
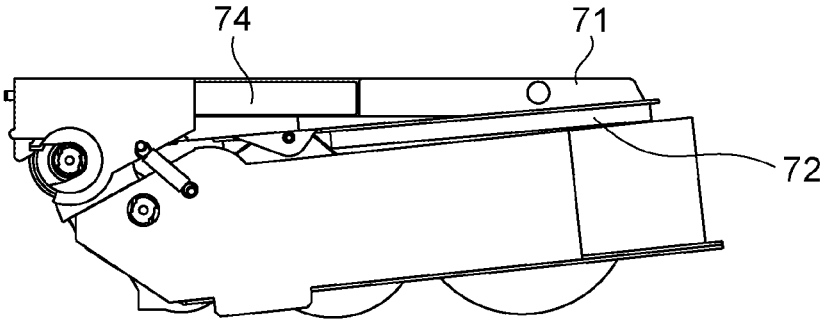
Figure 10:
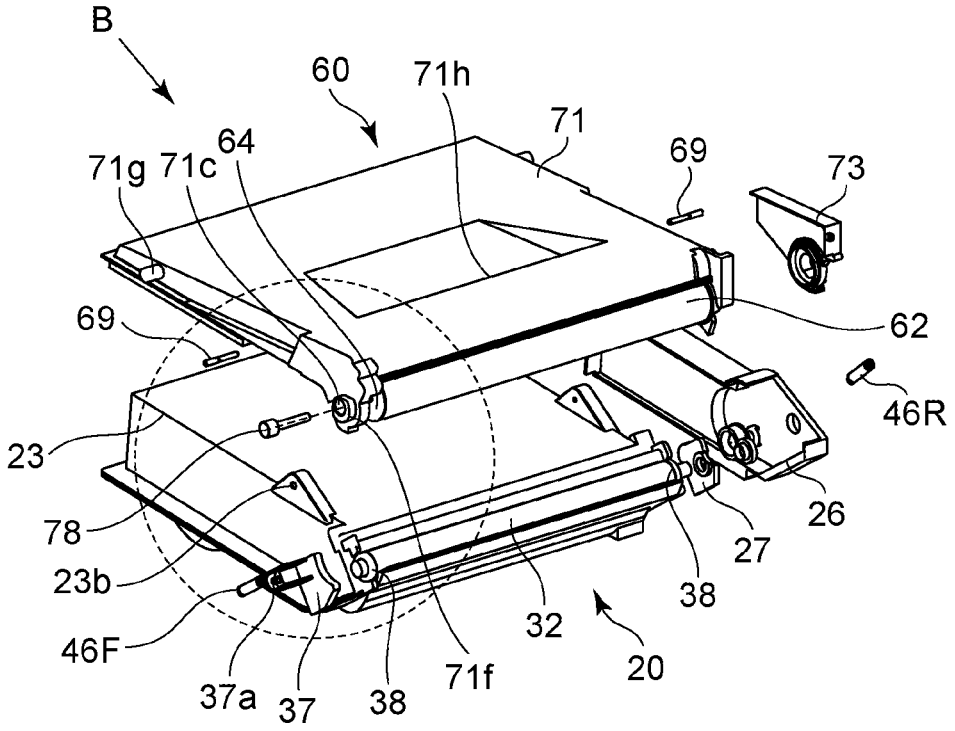
FIG. 10 is a disassembled state of the process cartridge.
Figure 11:
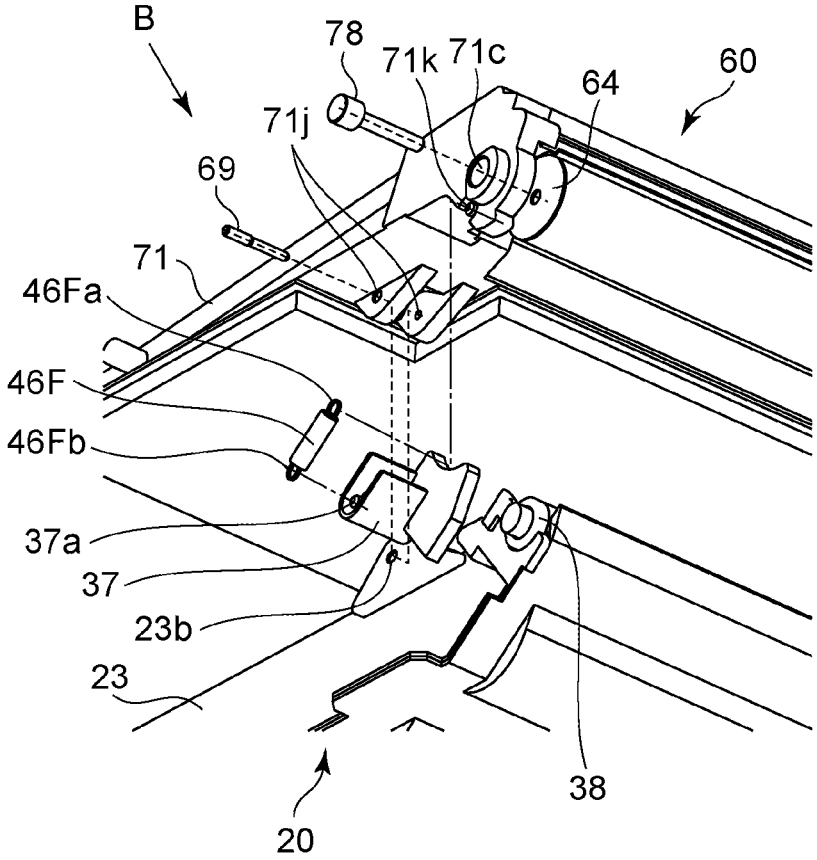
FIG. 11 is a disassembled state of the process cartridge.
Figure 12:
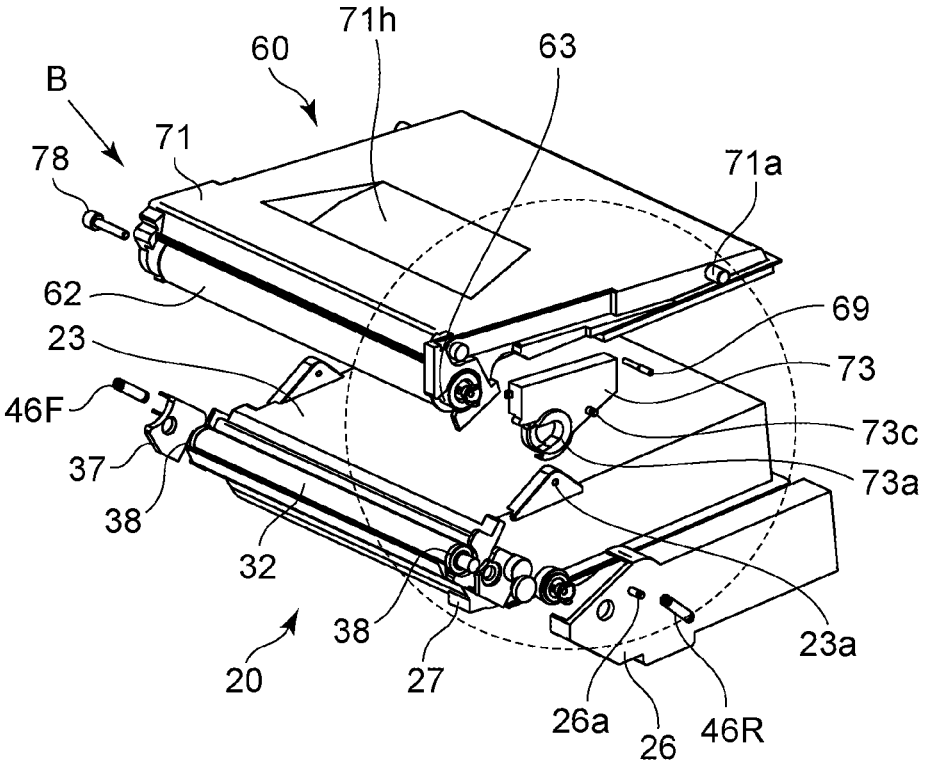
FIG. 12 is a disassembled state of the process cartridge.
Figure 13:
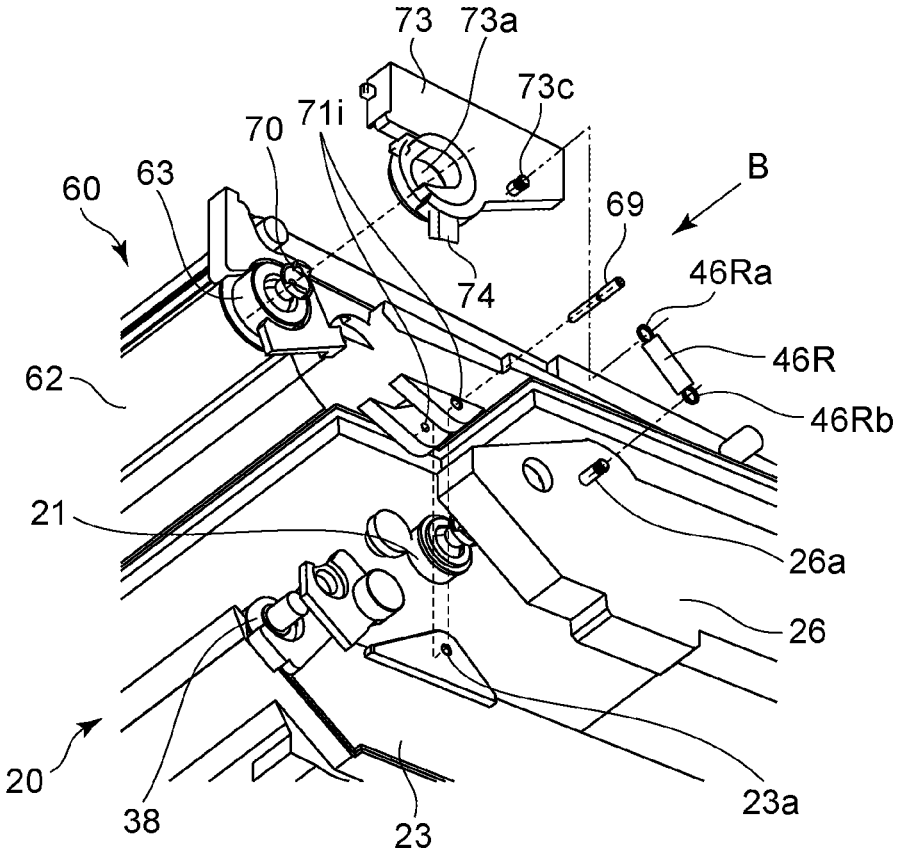
FIG. 13 is a disassembled state of the process cartridge.

The overall configuration of the cartridge B will be described with reference to FIGS. 3, 9A, 9B, 10, 11, 12, and 13. FIG. 3, 9A, and 9B are cross-sectional views of the cartridge B, and FIGS. 10, 11, 12, and 13 are perspective views illustrating the configuration of the cartridge B. FIGS. 11 and 13 are partially enlarged views of the portions inside the broken lines in FIGS. 10 and 12 viewed from angles different from those in FIGS. 10 and 12. Note that in the present exemplary embodiment, screws fastening the components are omitted from the description.

As illustrated in FIG. 3, the cartridge B of the present exemplary embodiment is an image forming unit that forms an image on a recording medium, and includes the cleaning unit 60 serving as a developer conveying unit that conveys developer, and the developing unit 20. In the present exemplary embodiment, a process cartridge in which the cleaning unit 60 and the developing unit 20 are joined together is described. However, not limited to the above, the cleaning unit 60 may be a cleaning device, and the developing unit 20 may be a conveying apparatus.

As illustrated in FIG. 3, the cleaning unit 60 includes the drum 62, the charge roller 66, a cleaning member 77, the cleaning frame 71 that supports the above members, and a lid member 72 that is fixed to the cleaning frame 71 by welding or the like. In the cleaning unit 60, the charge roller 66 and the cleaning member 77 are disposed so as to be in contact with the outer peripheral surface of the drum 62.

The cleaning member 77 of the present exemplary embodiment includes a rubber blade 77*a* that is a blade-shaped elastic member formed of rubber serving as an elastic material, and a supporting member 77*b* that supports the rubber blade. The rubber blade 77*a* is abutted against the drum 62 in a direction that counters a rotation direction of the drum 62. In other words, the rubber blade 77*a* is abutted against the drum 62 so that a tip of the rubber blade 77*a* is oriented towards the upstream side in the rotation direction of the drum 62. In the present example embodiment, the cleaning member is described using a cleaning blade; however, not limited to the above, a roller-shaped cleaning member can be used.

FIG. 9A is a cross-sectional view of the cleaning unit 60. As illustrated in FIGS. 3 and 9A, waste developer (hereinafter, referred to as waste toner) removed from the surface of the drum 62 with the cleaning member 77 is conveyed by the conveying members. Each conveying member includes at least a shaft and a conveying portion that conveys the toner.

In the present exemplary embodiment, a case in which the conveying members are screws will be described. As illustrated in FIGS. 9A and 9B, the cleaning unit 60 includes a first screw 86, a second screw 87, a third screw 88, the cleaning frame 71, a screw lid 74, and the lid member 72. A waste toner container 75 serving as a developer container is a member in which the cleaning frame 71, the screw lid 74, and the lid member 72 are joined together. The waste toner container 75 contains the waste toner.

After the first screw 86 serving as a first conveying member conveys the toner in the arrow X direction, the toner is further conveyed in the arrow Y direction with the second screw 87 serving as a second conveying member. Subsequently, the third screw 88 serving as a third conveying member provided inside the waste toner chamber 71*b* formed by the cleaning frame 71 and the screw lid 74 accumulates the toner in the waste toner chamber 71*b*. In the present exemplary embodiment, a rotational axis of the first screw 86 and that of the third screw 88 are parallel to a rotational axis of the drum 62, and a rotational axis of the second screw 87 is orthogonal to the rotational axis of the drum 62. However, the dispositional relationship does not have to be as above as long as the driving force is transmitted and the toner is conveyed. For example, the axis of the first screw and the axis of the second screw may intersect each other, and the rotational axis of the second screw may be inclined inwards from an end portion of the cartridge B in the longitudinal direction. Furthermore, the first screw and the third screw may be configured so that the axis of the first screw and the axis of the third screw do not have to be parallel to each other and have to intersect each other.

Each screw that is a conveying member is provided with the developer conveying portion that conveys the toner. It is only sufficient that the developer conveying portion is capable of conveying the waste toner, and the developer conveying portion may be provided with a spiral protrusion or may be provided with a plurality of twisted blade shapes. Furthermore, not limited to a screw, any structure that is capable of conveying the waste toner in the axial direction of the conveying member is sufficient and, for example, a coil may convey the waste toner.

Furthermore, as illustrated in FIG. 3, a drum abutting sheet 65 that prevents the waste toner from leaking from the cleaning frame 71 is provided at an end portion of the cleaning frame 71 so as to abut against the drum 62. The drum 62 is rotationally driven in the arrow R direction in the drawing in accordance with an image forming operation by receiving driving force from a main body drive motor (not shown) serving as a drive source.

As illustrated in FIG. 3, the developing unit 20 includes the developing roller 32, a developer container 23 that supports the developing roller 32, the developing blade 42, and other components. The developing roller 32 is disposed so that a central axis thereof extends in a direction that is the same as that of the rotational axis of the drum 62. The magnet roller 34 is provided inside the developing roller 32. Furthermore, a developing blade 42, which restricts the toner layer on the developing roller 32, is disposed in the developing unit 20. As illustrated in FIGS. 10 and 12, in the developing roller 32, gap maintaining members 38 are attached to the two end portions of the developing roller 32. By having the gap maintaining members 38 and the drum 62 abut against each other, the developing roller 32 and the drum 62 are held with a slight gap in between. Furthermore, as illustrated in FIG. 3, a developing roller abutting sheet 33 that prevents the toner from leaking from the developing unit 20 is provided so as to abut against the developing roller 32 at an end portion of a bottom member 22. Furthermore, the developer container is constituted by the developer container 23 and the bottom member 22, and includes the toner chamber 29 therein. The first conveying member 43, the second conveying member 44, and the third conveying member 50 are provided in the toner chamber 29. The first conveying member 43, the second conveying member 44, and the third conveying member 50 not only stir the toner accommodated inside the toner chamber 29 but also convey the toner to the toner supply chamber 28.

An opening 29*a* (a portion illustrated by a broken line) is provided between the toner chamber 29 and the toner supply chamber 28. The opening 29*a* is sealed by a sealing member 45 until the cartridge B is used. The sealing member 45 is a sheet-shaped member formed of a material such as polyethylene, and one end side thereof is adhered to the developer container 23 at a circumference of the opening 29*a*, and the other end side is fixed to the first conveying member 43. Furthermore, when the cartridge B is used for the first time and when the first conveying member 43 is rotated, the portion of the sealing member 45 adhered to the developer container 23 comes off and is wound by the first conveying member 43 and the opening 29*a* is opened.

As illustrated in FIGS. 10 and 12, the cartridge B is formed by connecting the cleaning unit 60 and the developing unit 20 to each other. The cleaning frame 71, the drum 62, and the drum bearing 73 and a drum shaft 78 for rotatably supporting the drum 62 are provided in the cleaning unit 60. As illustrated in FIG. 13, on the drive side, a drive side drum flange 63 fixed to a drive side end portion of the drum 62 is rotatably supported by a hole portion 73*a* of the drum bearing 73. The drive side drum flange 63 includes a coupling (a driving force receiving portion) 70. Driving force is transmitted to the coupling 70 engaged with a drive shaft 14 (see FIG. 7) of the apparatus main body A, and the coupling 70, the drum flange 63, and the drum 62 rotate in an integrated manner. Meanwhile, as illustrated in FIG. 11, the drum shaft 78 that is press-fitted into a hole portion 71*c* provided in the cleaning frame 71 is rotatably supported by the drum bearing 73.

Meanwhile, as illustrated in FIGS. 3, 10, and 12, the developing unit 20 is formed of the bottom member 22, the developer container 23, a developing side member 26 of the drive side, the developing blade 42, the developing roller 32, and other components. Furthermore, the developing roller 32 is rotatably attached to the developer container 23 with a bearing member 27 provided on the drive side, and a bearing member 37 provided on the non-drive side.

Furthermore, as illustrated in FIGS. 11 and 13, the cartridge B is formed by pivotably connecting the cleaning unit 60 and the developing unit 20 to each other with connection pins 69. Specifically, at each end portion of the developing unit 20 in the longitudinal direction, a first support hole 23*a* and a developing-unit second support hole 23*b* are provided in the developer container 23. Furthermore, at each end portion of the cleaning unit 60 in the longitudinal direction, first suspension holes 71*i* and second suspension holes 71*j* are provided in the cleaning frame 71. By having the connection pins 69 press-fitted and fixed in the first suspension holes 71*i* and the second suspension holes 71*j* fit into the developing-unit first support hole 23*a* and the developing-unit second support hole 23*b*, the cleaning unit 60 and the developing unit 20 are pivotably connected to each other.

Furthermore, a first hole portion 46Ra of a drive side urging member 46R is hooked on a boss 73*c* of the drum bearing 73, and a second hole portion 46Rb is hooked on a boss 26*a* of the developing side member 26 of the drive side. Furthermore, a first hole portion 46Fa of a non-drive side urging member 46F is hooked on a boss 71*k* of the cleaning frame 71, and a second hole portion 46Fb is hooked on a boss 37*a* of the bearing member 37.

The present exemplary embodiment is configured such that the drive side urging member 46R and the non-drive side urging member 46F are each a tension spring, and urging force of each spring is used to urge the developing unit 20 towards the cleaning unit 60 so that the developing roller 32 is reliably pushed towards the drum 62. Furthermore, the developing roller 32 is held so as to form a predetermined space with the drum 62 with the gap maintaining members 38 attached to the two end portions of the developing roller 32.

Charge Roller Holding Configuration

Figure 14:
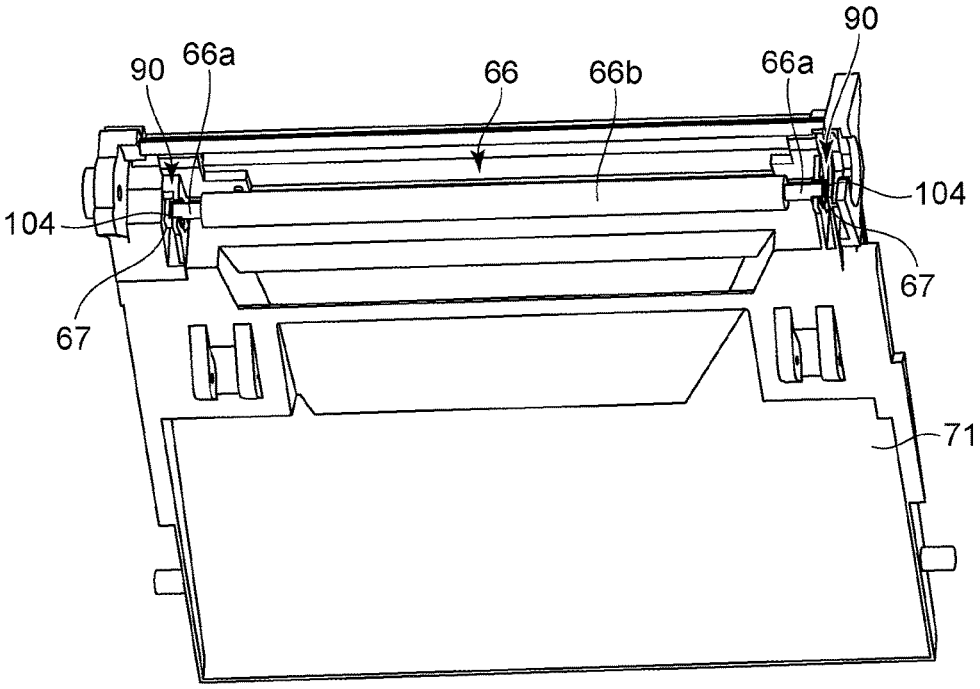
FIG. 14 is a perspective view of the cleaning unit of the process cartridge.
Figure 15:
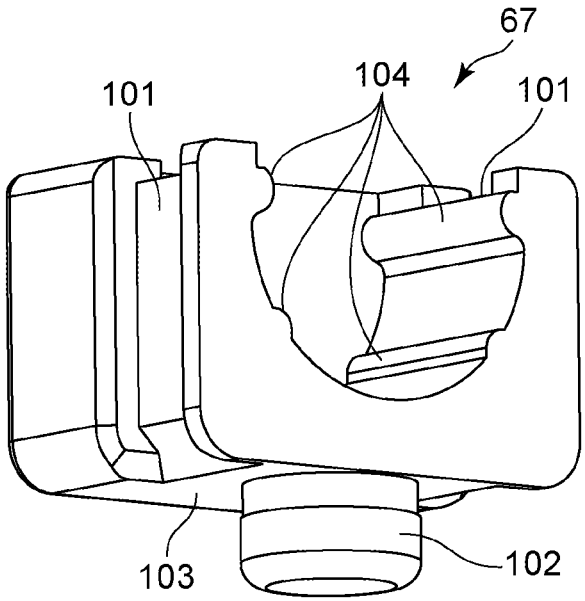
FIG. 15 is a perspective view of a bearing member of the process cartridge.
Figure 16:
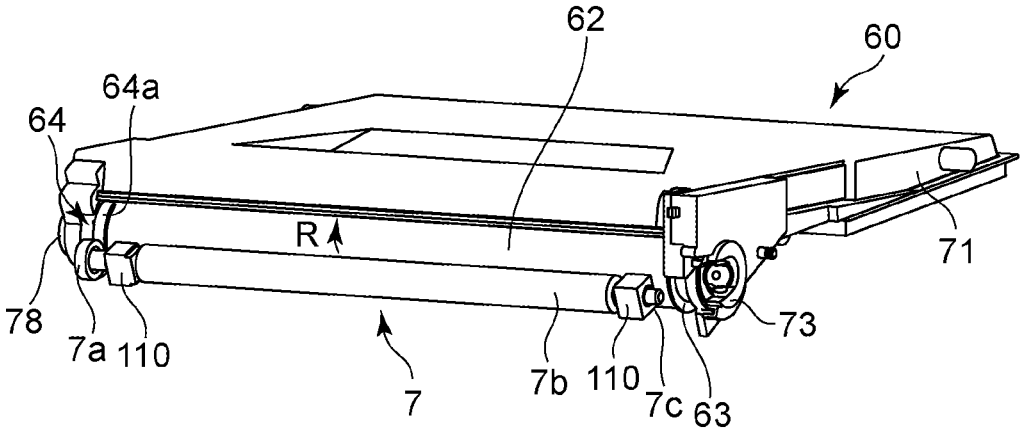
FIG. 16 is a perspective view of the cleaning unit of the process cartridge and the image forming apparatus main body.

Referring next to FIGS. 1, and 14 to 19, a holding configuration of the charge roller 66 will be described. FIGS. 1, 17, 18A, 18B, 18C, and 19 are cross-sectional views of the cleaning unit 60 for describing the charge roller holding configuration. FIG. 14 is a perspective view of the cleaning frame 71, the charge roller 66, and the charge roller holding configuration for describing the charge roller holding configuration. Note that in FIGS. 17 to 19, for the sake of description, a gap between a first guide surface 91*a* and a first guided surface 101*a*, and a gap between a second guide surface 91*b* and a second guided surface 101*b* are exaggerated. FIG. 15 is a perspective view of a charge roller bearing 67. FIG. 16 is a perspective view illustrating configurations of the drum 62 and the transfer roller 7.

As illustrated in FIG. 14, each end portion of the cleaning frame 71 in the longitudinal direction of the charge roller 66 is provided with the charge roller bearings (bearing members) 67 and charge structure holding portions 90 that support charge roller springs 68 serving as urging members. Furthermore, the charge roller 66 includes a metal core portion 66*a* and a rubber portion 66*b* that coats the circumference of the metal core portion 66*a*. Two ends of the metal core portion 66*a* are inserted in bearings 104 of the two charge roller bearings 67, and are held in a rotatable manner. A longitudinal direction of the charge roller 66 is parallel to a rotational axis direction of the charge roller 66. Hereinafter, while a description of the charge roller bearing 67 and the charge structure holding portion 90 will be given, the charge roller bearing 67 and the charge structure holding portion 90 are both provided, in the longitudinal direction of the charge roller 66, on a first end side corresponding to the non-drive side of the drum 62 and on the other end side corresponding to the drive side of the drum 62. Since the configurations of the above are the same, the configurations on the first end side will be described.

Figure 1:
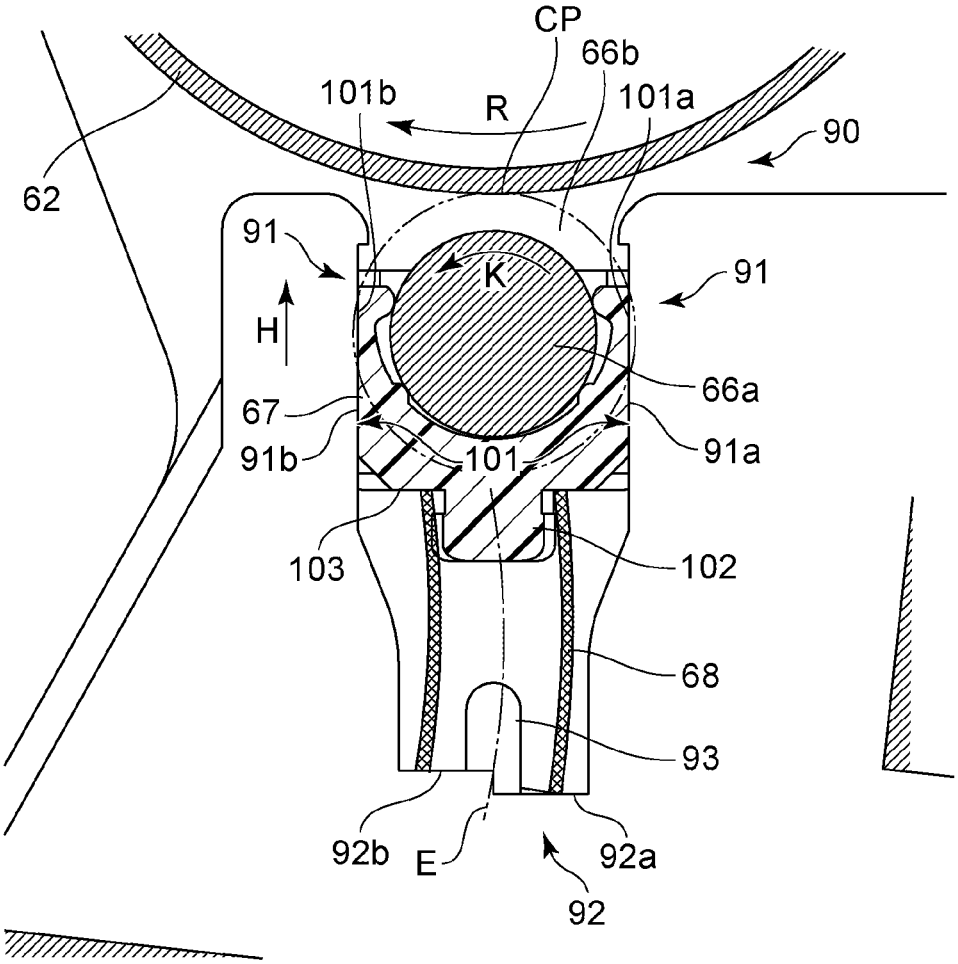
FIG. 1 is a cross-sectional view of a cleaning unit of a process cartridge.

As illustrated in FIG. 1, the charge structure holding portion 90 includes a charge roller bearing guide surfaces (guide portions) 91, a charge roller spring seat surface 92, and a charge roller spring engaging portion 93. The charge roller bearing guide surfaces 91 include the first guide surface 91*a* and the second guide surface 91*b* that are flat opposing surfaces that are parallel to each other. It is only sufficient that the first guide surface 91*a* and the second guide surface 91*b* are practically parallel to each other, and when the charge structure holding portions 90 are manufactured by election molding or the like, taking releasability from the mold into consideration, the second guide surface 91*b* may be slightly inclined against the first guide surface 91*a*. The first guide surface 91*a* is disposed upstream of the second guide surface 91*b* in a rotation direction R (the arrow R direction) of the drum 62. Furthermore, the charge roller spring seat surface 92 is a surface that is interposed between the first guide surface 91*a* and the second guide surface 91*b* in the rotation direction R of the drum 62, and is a surface that opposes the drum 62. The charge roller spring engaging portion 93 is provided on the charge roller spring seat surface 92. The charge roller spring seat surface 92 is formed of a first seat surface 92*a* and a second seat surface 92*b*, and the first seat surface 92*a* is disposed upstream of the second seat surface 92*b* in the rotation direction R of the drum 62. The first seat surface 92*a* and the second seat surface 92*b* are in contact with and support the charge roller spring 68.

As illustrated in FIG. 15, charge roller bearing guided surfaces 101, a charge roller spring fitting portion 102, a charge roller spring receiving surface 103, and a bearing 104 are provided in the charge roller bearing 67. The bearing 104 includes four ribs. As illustrated in FIG. 1, the charge roller bearing 67 engages with the charge roller bearing guide surfaces 91, and by having the charge roller bearing guided surfaces 101 be restricted by the charge roller bearing guide surfaces 91, the charge roller bearing 67 is held so as to be movable in an H direction that approaches the drum 62. The H direction that approaches the drum 62 is defined as a direction orthogonal to a tangential line of the charge roller 66 at a contact point CP between the charge roller 66 and the drum 62 and to the rotational axis direction of the charge roller 66. In the present exemplary embodiment, the H direction is a direction that extends parallel to the first guide surface 91*a* and the second guide surface 91*b* and that is orthogonal to the rotational axis direction of the charge roller 66. Furthermore, an I direction is defined as a direction that is parallel to a direction in which the tangential line of the charge roller 66 at the contact point CP between the charge roller 66 and the drum 62 extends and that is orthogonal to the rotational axis direction of the charge roller 66. The I direction has an orthogonal relationship with the H direction. Furthermore, the first guided surface 101*a* is disposed upstream of the second guided surface 101*b* in the rotation direction R of the drum 62. Furthermore, the charge roller spring 68 is disposed between the charge roller spring seat surface 92 and the charge roller spring receiving surface 103. In the present exemplary embodiment, a compression spring is used as the charge roller spring 68. An end portion of the charge roller spring 68 on one side is engaged with the charge roller spring engaging portion 93, and an end portion on the other side is fitted to the charge roller spring fitting portion 102. Each end portion of the charge roller spring 68 is a solid coiling to prevent each end portion from falling out.

In a state in which the drum 62 is installed, the charge roller 66 receiving the urging force (elastic force) of the charge roller spring 68 through the charge roller bearing 67 is urged in the H direction, and is abutted against the drum 62 at a predetermined pressure. When the charge roller bearing 67 is pressed so as to counter the urging force of the charge roller spring 68, by having the charge roller bearing guided surfaces 101 be guided by the charge roller bearing guide surfaces 91, the charge roller bearing 67 can be moved in a direction opposite the H direction. Furthermore, when the drum 62 is rotated in the R direction, the charge roller 66 is driven to rotate by the rotation of the drum 62 in a K direction with frictional force between the rubber portion 66*b* and the surface of the drum 62.

Furthermore, as illustrated in FIG. 16, in a state in which the cartridge B is mounted in the apparatus main body A, the transfer roller 7 provided in the apparatus main body A is disposed so as to be parallel to the axial direction of the drum 62 and abut against the drum 62. The transfer roller 7 includes a transfer gear 7*a*, a transfer portion 7*b*, and a sliding portion 7*c*. The sliding portion 7*c* of the transfer roller 7 engages with a transfer bearing member 110, and is rotatably held by the apparatus main body A. A drum gear (a gear portion) 64*a* is provided in the non-drive side drum flange 64, and the transfer gear 7*a* and the drum gear 64*a* engage with each other. By having the transfer gear 7*a* receive driving force from the drum gear 64*a*, the driving force is transmitted to the transfer roller 7 and the transfer roller is rotated.

Figure 17:
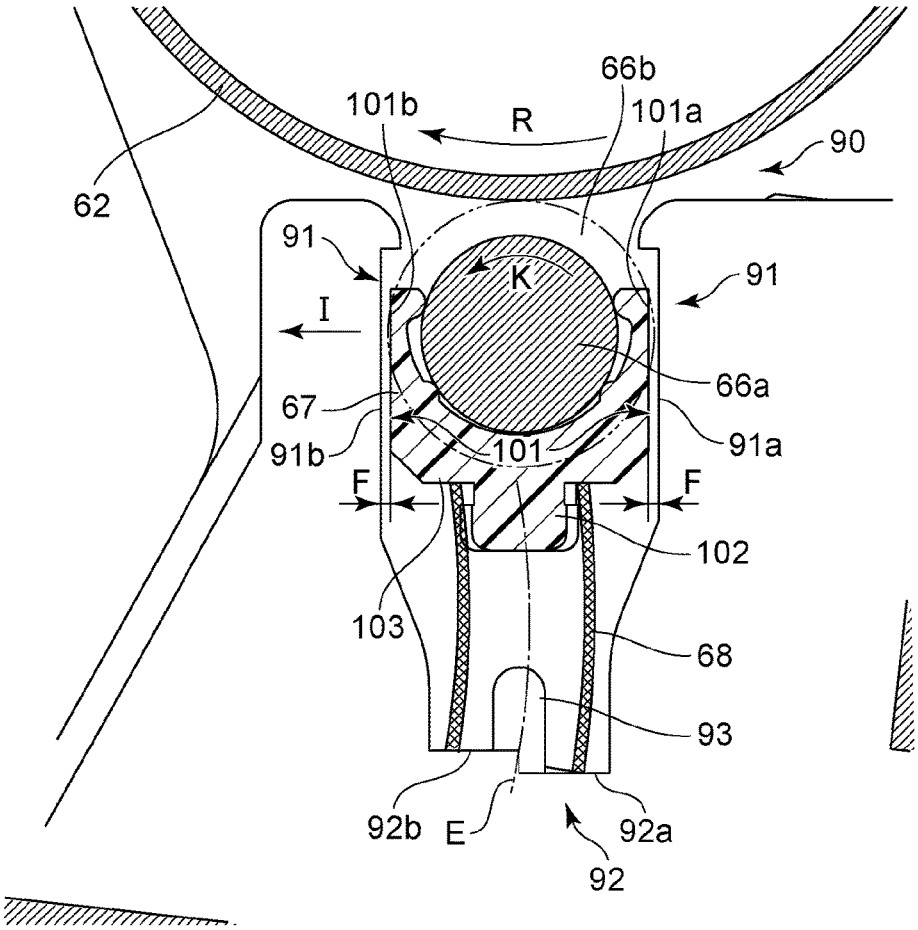
FIG. 17 is a cross-sectional view of the cleaning unit of the process cartridge.
Figure 18A:
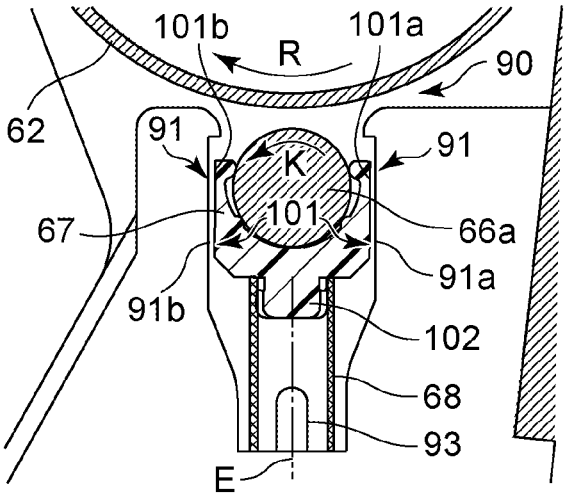
FIGS. 18A to 18C are cross-sectional views of the cleaning unit of the process cartridge.
Figure 18B:
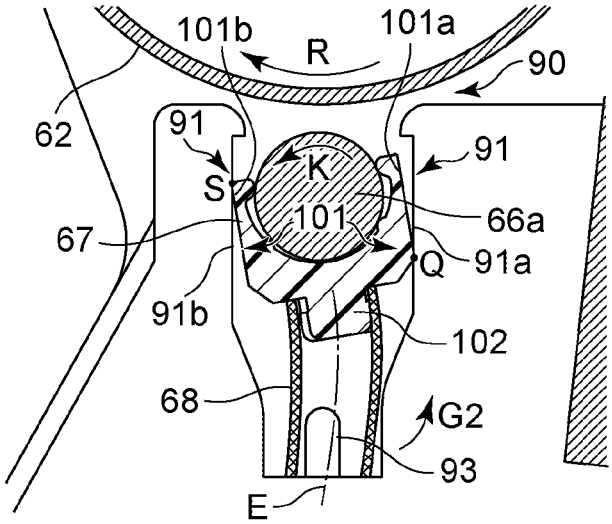
Figure 18C:
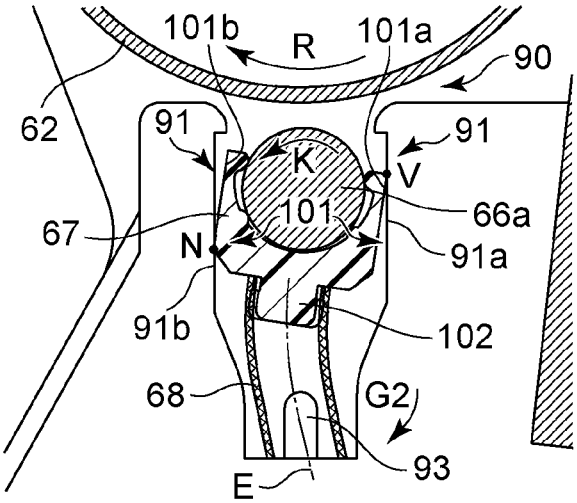

Referring next to FIG. 17, a position of the charge roller bearing 67 inside the charge roller bearing guide surfaces 91 when the drum 62 is in a stop state will be described. A width between the charge roller bearing guided surfaces 101 is slightly smaller than a width between the charge roller bearing guide surfaces 91, and gaps F are provided between the charge roller bearing guide surfaces 91 and the charge roller bearing guided surfaces 101. Furthermore, the charge roller bearing 67 is capable of slightly moving between the charge roller bearing guide surfaces 91 within the area of the gaps F. Furthermore, the position of the charge roller bearing 67 with respect to the charge roller bearing guide surfaces 91 can be determined by the urging direction or the like of the charge roller spring 68. In FIG. 18A, the position of the charge roller bearing 67 in a case in which a central axis E of the charge roller spring 68 is attached parallel to the charge roller bearing guide surfaces 91 is illustrated. In FIG. 18B, the position of the charge roller bearing 67 in a case in which the central axis E of the charge roller spring 68 is bent towards the upstream side in the rotation direction of the drum 62 is illustrated. In FIG. 18C, the position of the charge roller bearing 67 in a case in which the central axis E of the charge roller spring 68 is bent towards the downstream side in the rotation direction of the drum 62 is illustrated. When viewing the cross section of the charge roller spring 68 orthogonal to the H direction, the charge roller spring 68 has an annular cross section. The central axis E of the charge roller spring 68 is defined as a line connecting the center points of the annuluses. In the cases of FIGS. 18B and 18C, the charge roller bearing 67 receives a restoring moment G2 from the bent charge roller spring 68. As a case in which the charge roller spring 68 is bent, one can conceive of a case in which the charge roller spring 68 is installed in the charge roller spring fitting portion 102 at an angle. Furthermore, the bending may be caused by variations in the angles of the charge roller spring seat surface 92 and the charge roller bearing guide surfaces 91 during manufacturing. When the charge roller spring 68 is an open ended spring or is a close ended spring with no grinding performed thereto, since the bottom surface of the charge roller spring 68 comes in contact with the charge roller spring seat surface 92 at an angle, bending may occur.

Figure 19:
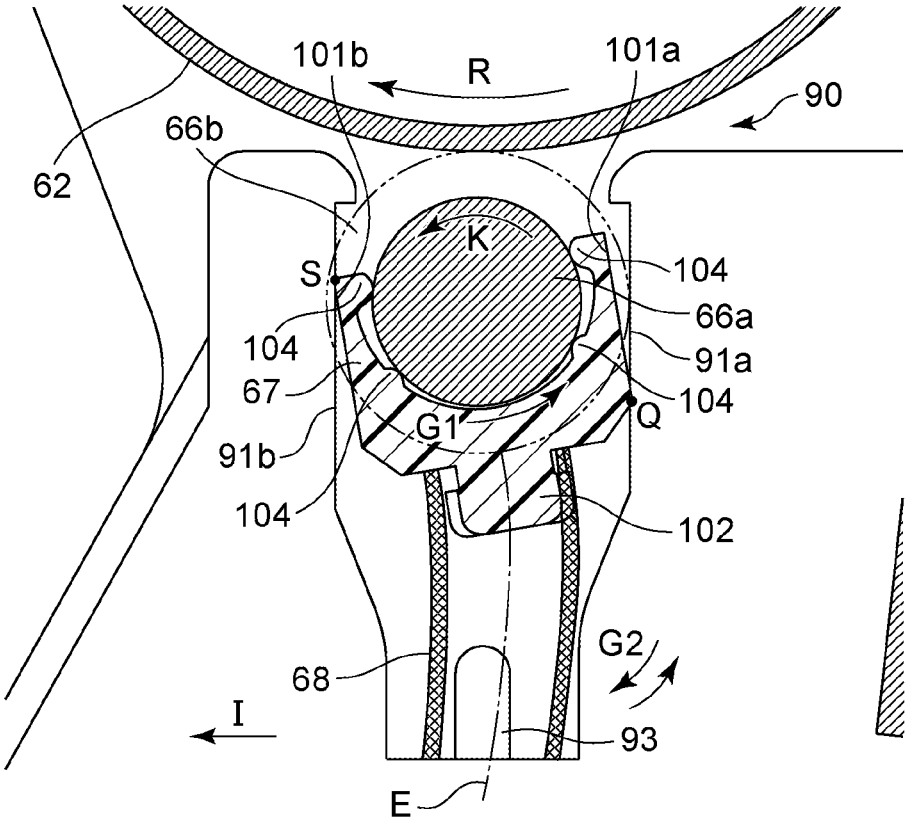
FIG. 19 is a cross-sectional view of the cleaning unit of the process cartridge.
Figure 20:
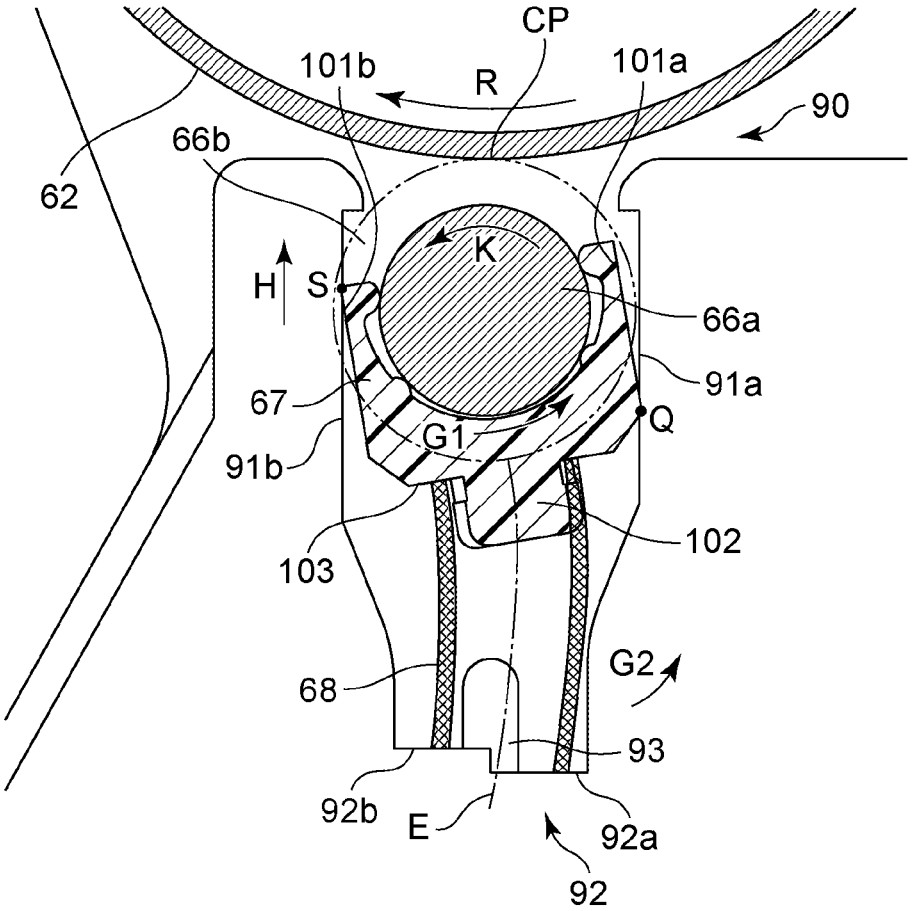
FIG. 20 is a cross-sectional view of the cleaning unit of the process cartridge.

A position of the charge roller bearing 67 inside the charge roller bearing guide surfaces 91 when the drum 62 is in a driven state will be described next. As illustrated in FIG. 19, when the drum 62 is driven, the charge roller 66 receives force in the I direction created by a friction between the drum 62 and the rubber portion 66*b*, and a sliding friction moment G1 caused by sliding between the bearings 104 and the metal core portion 66*a* of the charge roller 66. Furthermore, as described above, a restoring moment G2 from the charge roller spring 68 acts on the charge roller bearing 67. The position of the charge roller bearing 67 is determined by the dynamics between the above moments. For example, in a case in which the directions of G1 and G2 are the same, as illustrated in FIG. 18B, the charge roller bearing 67 will be in an inclined position in which the second guide surface 91*b* and the second guided surface 101*b* come in contact with each other at point S, and the first guide surface 91*a* and the first guided surface 101*a* come in contact with each other at point Q. Furthermore, in a case in which G1 and G2 are oriented in opposite directions, and when G1>G2, the position is as in FIG. 18B, and when G1<G2, as illustrated in FIG. 18C, the charge roller bearing 67 will be in an inclined position in which the second guide surface 91*b* and the second guided surface 101*b* come in contact with each other at point N, and the first guide surface 91*a* and the first guided surface 101*a* come in contact with each other at point V. Detailed mechanism in which jitter of charge roller occurs Referring next to FIGS. 1, 18A, 18B, 18C, and 20, a mechanism in which the jitter of the charge roller 66 occurs will be described. FIG. 20 is a cross-sectional view of the cleaning unit 60 for describing the charge roller holding configuration. Note that in FIG. 20, for the sake of description, similar to FIG. 19, the gap between the first guide surface 91*a* and the first guided surface 101*a*, and the gap between the second guide surface 91*b* and the second guided surface 101*b* are exaggerated.

There are cases in which the rotation speed of the drum 62 changes minutely (micro jitters occur) due to the effect of the gear accuracy and the change in the load of the drive system such as the transfer gear 7*a* and the drum gear 64*a*. When a jitter occurs while the drum 62 is driven, the frictional force between the drum 62 and the rubber portion 66*b* may change and the jitter or the contact state of the charge roller 66 may change. As a result, an uneven charge of the drum 62 charged with the charge roller 66 occurs, which becomes an inducer of an adverse effect on the image such as an uneven density of the toner.

In the above, there are cases in which the sliding friction moment G1 changes due to the jitter of the drum 62. Cases in which a restoring moment G2 acts in a direction opposite to the that of the sliding friction moment G1, and in which the sliding friction moment G1 changes between a size exceeding the restoring moment G2 and a size that does not exceed the restoring moment G2 will be described. In such a case, there are cases in which the position of the charge roller bearing 67 shifts between the position in FIG. 18B and the position in FIG. 18C, and the vibration of the charge roller bearing 67 becomes large. When the vibration of the charge roller bearing 67 becomes large in such a manner, there are cases in which the jitter or the change in the contact state of the charge roller 66 becomes large. Since the change in rotation speed of the drum 62 occurs more easily particularly in the portion of the drum 62 on the non-drive side where the drum gear 64*a* is disposed, there are cases in which the vibration of the charge roller bearing 67 becomes large.

Accordingly, the present exemplary embodiment is configured in a manner illustrated in FIG. 1. In other words, the second seat surface 92*b* disposed downstream of the first seat surface 92*a* in the rotation direction R of the drum is disposed closer to the contact point CP, between the charge roller 66 and the drum 62, than the first seat surface 92*a*, in the H direction parallel to the first guide surface 91*a* and the second guide surface 91*b*.

In the above, the distance between the first seat surface 92*a* and the charge roller spring receiving surface 103 is larger than the distance between the second seat surface 92*b* and the charge roller spring receiving surface 103. Accordingly, as illustrated in FIG. 20, the charge roller spring 68 is bent towards the upstream side in the rotation direction of the drum 62 even when the charge roller 66 and the drum 62 are in a relatively stopped state. In the above, the contact point (a second contact point) S between the second guide surface 91*b* and the second guided surface 101*b* is, in the H direction, closer to the contact point CP between the charge roller 66 and the drum 62 than the contact point (a first contact point) Q between the first guide surface 91*a* and the first guided surface 101*a*.

Note that it is desirable that the first seat surface 92*a* and the second seat surface 92*b* be provided with heights that allow the first seat surface 92*a* and the second seat surface 92*b* to be, in the H direction, sufficiently close to the contact point CP between the charge roller 66 and the drum 62 so that the direction of the restoring moment G2 is the same as that of the sliding friction moment G1.

By having the above configuration, the direction of the restoring moment G2 can be made the same as that of the sliding friction moment G1 and the vibration of the charge roller bearing 67 can be suppressed so that the position can be made stable in the position illustrated in FIGS. 18B and 20. As a result, uneven charging can be suppressed, and the possibility of an adverse effect on the image such as an uneven density occurring can be reduced.

Figure 21:
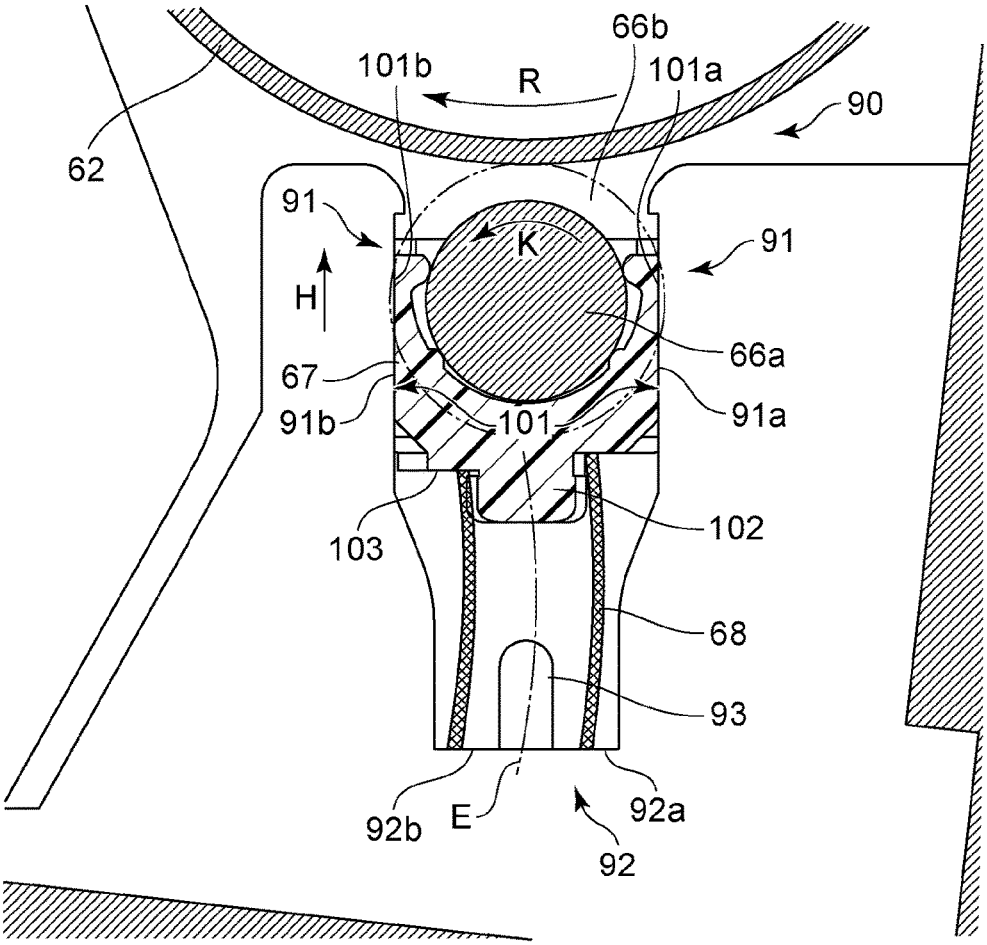
FIG. 21 is a cross-sectional view of the cleaning unit of the process cartridge.

Furthermore, as illustrated in FIG. 21, by providing a step in the charge roller bearing 67, the distance between the charge roller spring receiving surface 103 and the charge roller spring seat surface 92 may be changed to bend the charge roller spring 68 towards the upstream side in the rotation direction of the drum 62.

Note that depending on how the rotation speed of the drum 62 changes, the charge roller bearing 67 disposed on the second end side (corresponding to the drive side of the drum 62) of the charge roller 66 in the longitudinal direction does not have to be configured in the above described manner. In other words, if at least the charge roller bearing 67 disposed on the first end side (the non-drive side of the drum 62) of the charge roller 66 in the longitudinal direction where the change in the rotation speed of the drum 62 easily occurs is configured in the above described manner, an effect of suppressing uneven charging can be obtained.

Second Exemplary Embodiment

A second exemplary embodiment of present disclosure will be described next. Note that in the exemplary embodiments hereinafter, portions that are different from those in the first exemplary embodiment will be described in detail. Unless described again, the materials and the shapes are similar to those of the first exemplary embodiment. Such components will be attached with the same reference numerals and detailed description thereof will be omitted.

Figure 22:
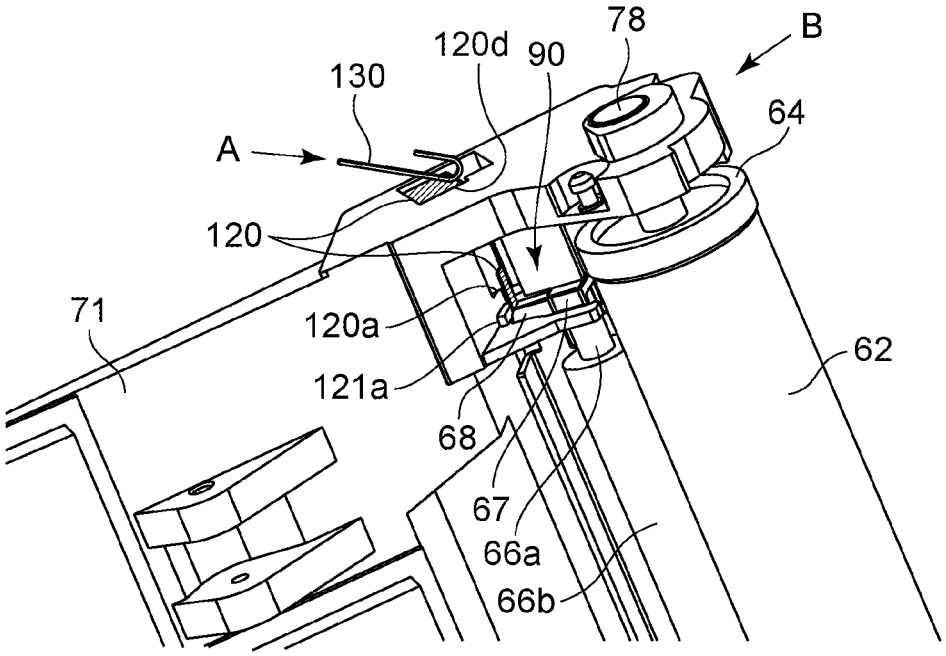
FIG. 22 is a perspective view of the cleaning unit the image forming apparatus main body.
Figure 23:
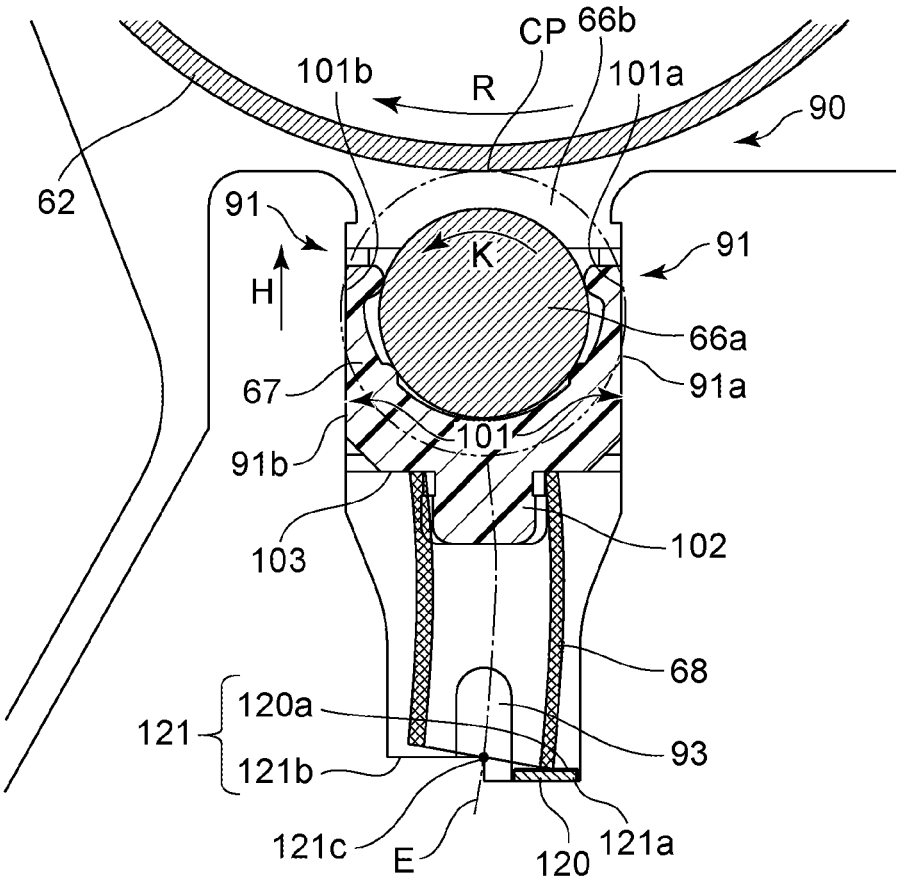
FIG. 23 is a cross-sectional view of the cleaning unit of the process cartridge.

Referring to FIGS. 22 and 23, a conduction configuration of the second exemplary embodiment to apply a bias voltage to the charge roller 66 will be described. FIG. 22 is a perspective view of a portion of the apparatus main body A and the cleaning unit 60 related to the second exemplary embodiment, and FIG. 23 is a cross-sectional view of the cleaning unit 60 for describing the charge roller holding configuration.

In the second exemplary embodiment, as illustrated in FIG. 22, a charging contact 130 of the main body and a charging bias power source (not shown) are provided in the apparatus main body A, and charging contact 120 are provided in the cleaning frame 71. The charging contact 130 of the main body is connected to the charging bias power source. Note that the charging contact 130 of the main body, the charge roller spring 68, the metal core portion 66*a* are formed of conductive members such as a metal. The charge roller bearing 67 is formed of conductive resin. Furthermore, the charging contact 120 is formed of a metal plate. Accordingly, at least the charge roller bearing 67, the charge roller spring 68, and the charging contact 120 are electrically connected to each other.

When the cartridge B is mounted in the apparatus main body A, the charging contact 130 of the main body comes in contact with and becomes electrically connected to a contact portion 120*d* of the charging contact 120 exposed externally. During the image-forming period, the charging bias power source applies a charging bias to the rubber portion 66*b* through a main body power supply contact 130, the charging contact 120, the charge roller spring 68, the charge roller bearing 67, and the metal core portion 66*a*.

A first end portion of the charging contact 120 is disposed so as to be exposed externally as a contact portion 120*d*, and a contact seat surface 120*a* is provided on a surface of a second end portion. Furthermore, in the charge structure holding portion 90 of the cleaning frame 71, a non-contact seat surface 121*b* and an attaching surface 121*a* are provided in place of the charge roller spring seat surface 92 in the first exemplary embodiment. The contact seat surface 120*a* extends to the attaching surface 121*a*. As illustrated in FIG. 23, the charge roller spring 68 is disposed across the non-contact seat surface 121*b* and the contact seat surface 120*a* on the attaching surface 121*a*. Note that the contact seat surface 120*a* is disposed upstream of the charge roller spring engaging portion 93 in the rotation direction of the drum 62, and the non-contact seat surface 121*b* is disposed downstream thereof. Furthermore, in the configuration of the present exemplary embodiment, the non-contact seat surface 121*b* is, in the H direction, closer to the contact point CP between the charge roller 66 and the drum 62 than the contact seat surface 120*a*.

A charge roller spring conducting seat surface 121 includes the non-contact seat surface 121*b* and the contact seat surface 120*a*. The charge roller spring 68 is disposed between the charge roller spring conducting seat surface 121 and the charge roller spring receiving surface 103. In the above, the charge roller spring 68 is in contact with the contact seat surface 120*a* and a non-contact seat surface edge portion 121*c* of the non-contact seat surface 121*b*.

In the present exemplary embodiment, the contact seat surface 120*a* is disposed upstream of the non-contact seat surface 121*b* in the rotation direction R of the drum 62, and is, in the H direction, disposed at a distance farther away from the contact point CP between the charge roller 66 and the drum 62 than the non-contact seat surface 121*b*. With the above, the charge roller spring 63 can be reliably in contact with the contact seat surface 120*a*. Accordingly, in addition to an effect similar to that of the first exemplary embodiment, the charging bias can be conducted in a stable manner.

Note that depending on how the rotation speed of the drum 62 changes, the charge roller bearing 67 disposed on the second end side (corresponding to the drive side of the drum 62) of the charge roller 66 in the longitudinal direction does not have to be configured in the above described manner. In other words, if at least the charge roller bearing 67 disposed on the first end side (the non-drive side of the drum 62) of the charge roller 66 in the longitudinal direction where the change in the rotation speed of the drum 62 easily occurs is configured in the above described manner, an effect of suppressing uneven charging can be obtained.

Third Exemplary Embodiment

Figure 24:
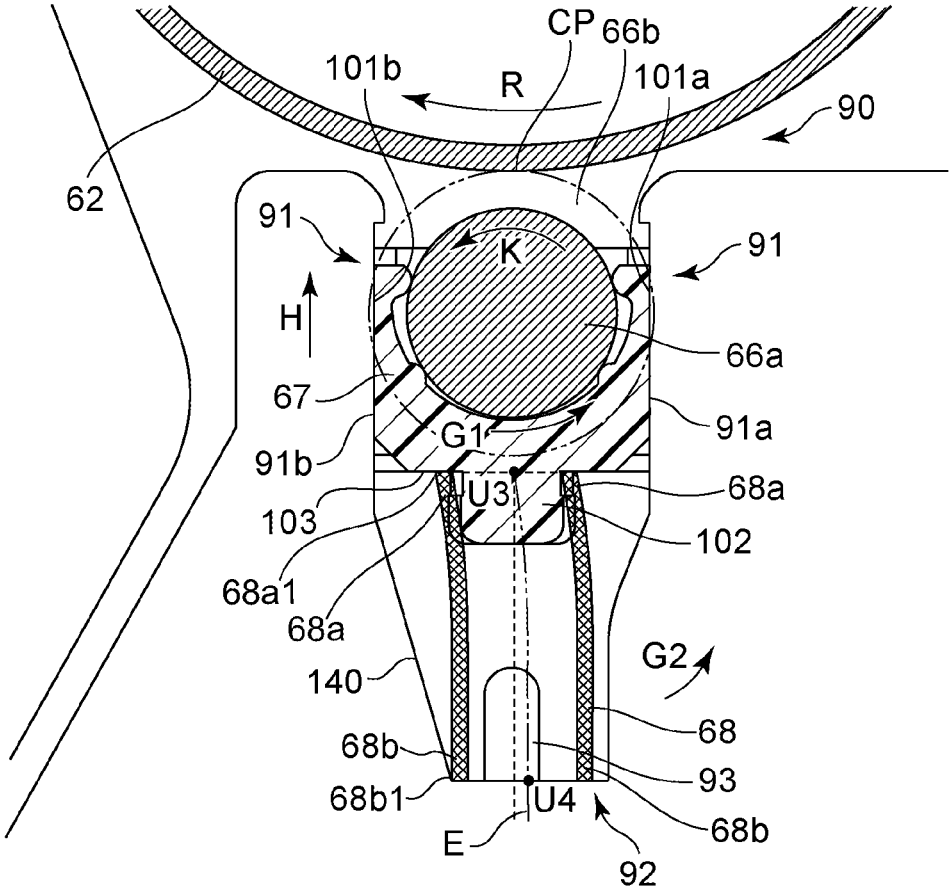
FIG. 24 is a cross-sectional view of the cleaning unit of the process cartridge.

A third exemplary embodiment of the present disclosure will be described next. In the present exemplary embodiment, as illustrated in FIG. 24, a guiding surface 140 that positionally guides the charge roller spring 68 is provided between the second guide surface 91*b* and the charge roller spring seat surface 92. In the charge roller spring 68, a portion in contact with the charge roller bearing 67 (an upper portion of the charge roller spring 68 in FIG. 24) is referred to as a first end portion 68*a*, and a portion in contact with the charge roller spring seat surface 92 (a lower portion of the charge roller spring 68 in FIG. 24) is referred to as a second end portion 68*b*. The position of the first end portion 68*a* of the charge roller spring 68 in the rotation direction of the drum 62 is determined by having the first end portion 68*a* of the charge roller spring 68 be fitted to the charge roller spring fitting portion (a first position restriction portion) 102. The position of the second end portion 68*b* of the charge roller spring 68 in the rotation direction of the drum 62 is determined by having the second end portion 68*b* of the charge roller spring 68 come in contact with the guiding surface (a second position restriction portion) 140. With the above, when U3 is an intersection point between the charge roller spring receiving surface 103 and the central axis E of the charge roller spring 68, and U4 is an intersection point between the charge roller spring seat surface 92 and the central axis E, U4 is upstream of U3 in the rotation direction of the drum 62. In other words, the first end portion of the charge roller spring 68 is engaged with the charge roller bearing 67 to restrict the position in the rotation direction of the drum 62, and the second end portion is, while the position thereof is restricted in the rotation direction of the drum 62 by the guiding surface 140, held by the charge roller spring seat surface 92. With the above, the first end portion 68*a* of the charge roller spring 68 is disposed downstream of the second end portion 68*b* in the rotation direction of the drum 62.

Description will be given w the position of a downstream-most point 68*a*1 in the first end portion 68*a* of the charge roller spring 68 in the rotation direction of the drum 62 and a position of a downstreammost point 68*b*1 in the second end portion 68*b* of the charge roller spring 68 in the rotation direction of the drum 62 are compared. In other words, the point 68*a*1 is disposed downstream of the point 68*b*1 in the rotation direction of the drum 62.

With such a configuration, the orientation of the restoring moment G2 of the bent charge roller spring 68 can be the same as the direction of the sliding friction moment G1. Accordingly, in the state illustrated in FIG. 20 in which the charge roller 66 and the drum 62 are relatively stopped with respect to each other, the charge roller bearing 67 is disposed so that, in the H direction, the contact point S is closer to the contact point CP than the contact point Q. By disposing the charge roller bearing 67 at such a position, the vibration of the charge roller bearing 67 can be suppressed and the position thereof can be stabilized.

Note that depending on how the rotation speed of the drum 62 changes, the charge roller bearing 67 disposed on the second end side (corresponding to the drive side of the drum 62) of the charge roller 66 in the longitudinal direction does not have to be configured in the above described manner. In other words, if at least the charge roller bearing

67 disposed on the first end side (the non-drive side of the drum 62) of the charge roller 66 in the longitudinal direction where the change in the rotation speed of the drum 62 easily occurs is configured in the above described manner, an effect of suppressing uneven charging can be obtained.

Fourth Exemplary Embodiment

Figure 25:
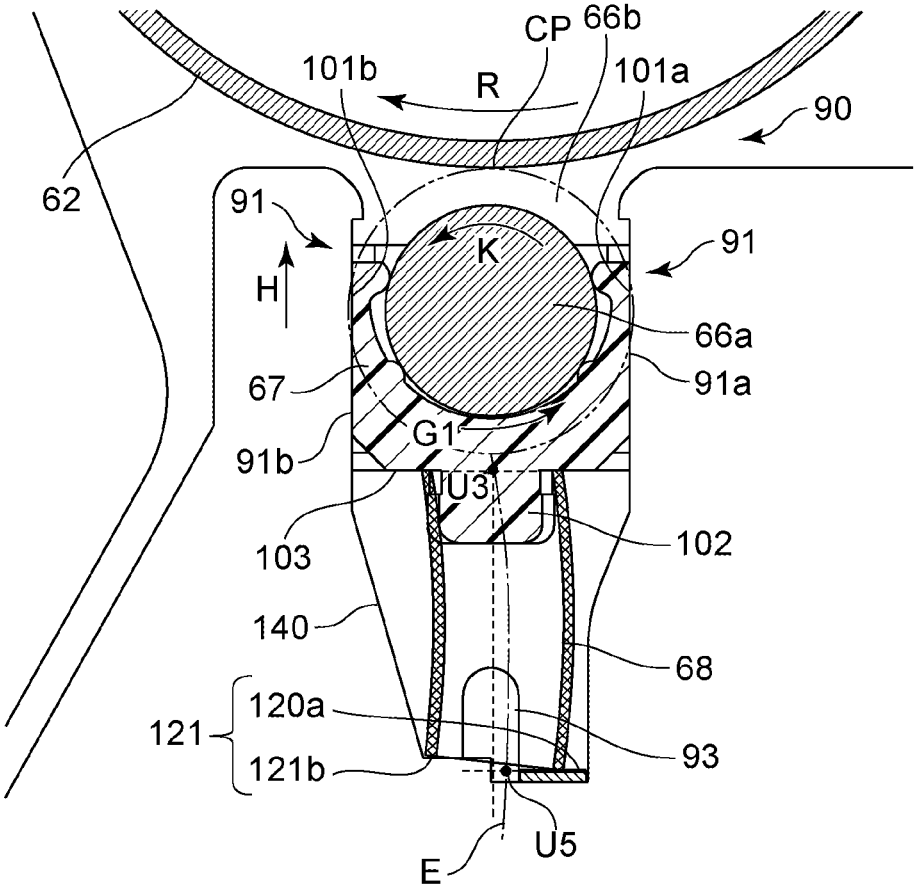
FIG. 25 is a cross-sectional view of the cleaning unit of the process cartridge.

A fourth exemplary embodiment of the present disclosure will be described next. As illustrated in FIG. 25, the configuration of the present exemplary embodiment a combination of the configurations of the second exemplary embodiment and the third exemplary embodiment 3. In other words, the non-contact seat surface 121*b* is positioned higher in the H direction approaching the drum 62 than the position of the contact seat surface 120*a* and, furthermore, the guiding surface 140 is provided so that an intersection point U5 between the charge roller spring conducting seat surface 121 and the central axis E is upstream of an intersection point U3 in the rotation direction of the drum 62. In such a configuration as well, as illustrated in FIG. 20 in which the charge roller 66 and the drum 62 are relatively stopped with respect to each other, the charge roller bearing 67 is disposed so that, in the H direction, the contact point S is closer to the contact point CP than the contact point Q. As described above, even when the configurations described above are combined, the vibration of the charge roller bearing 67 can be suppressed and the position thereof can be stabilized without losing each of the effects.

Note that depending on how the rotation speed of the drum 62 changes, the charge roller bearing 67 disposed on the second end side (corresponding to the drive side of the drum 62) of the charge roller 66 in the longitudinal direction does not have to be configured in the above described manner. In other words, if at least the charge roller bearing 67 disposed on the first end side (the non-drive side of the drum 62) of the charge roller 66 in the longitudinal direction where the change in the rotation speed of the drum 62 easily occurs is configured in the above described manner, an effect of suppressing uneven charging can be obtained.

The present disclosure is capable of suppressing the vibration of a roller in contact with the photosensitive member and preventing an adverse effect occur on an image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-100056 filed May 19, 2017, which is hereby incorporated by reference herein in its entirety.

What is claimed is:

1. A photosensitive drum unit comprising:

a photosensitive drum;

a frame having a guide portion and a seat surface and supporting the photosensitive drum so that the photosensitive drum is rotatable;

a driving member provided on one end side of the photosensitive drum in a rotational axis direction and configured to transmit driving force of the photosensitive drum;

a roller configured to come in contact with the photosensitive drum and to rotate together with the photosensitive drum;

a bearing member supporting the roller so that the roller is rotatable, disposed on the one end side of the photosensitive drum in the rotational axis direction, and configured to be guided by the guide portion so that the bearing member is movable in a direction perpendicular to the rotational axis; and an elastic member configured to urge the bearing member so that the roller comes in contact with the photosensitive drum, wherein a first end of the elastic member is supported by the bearing member and a second end of the elastic member opposite to the first end of the elastic member is supported by the seat surface, wherein the elastic member is supported by the bearing member and the seat surface so that a direction of a first rotational moment generated by a first force from the elastic member around a rotational axis of the roller acting on the bearing member, is same as a direction of a second rotational moment generated by a second force from the roller around the rotational axis of the roller acting on the bearing member, in a state in which the roller is rotated.

2. The photosensitive drum unit according to claim 1, wherein the seat surface includes a first seat surface and a second seat surface, with which the elastic member is configured to come into contact, wherein the first seat surface is disposed upstream of the second seat surface in a rotation direction of the photosensitive drum, and wherein, in an urging direction of the elastic member, the second seat surface is disposed closer to a contact point between the roller and the photosensitive drum than the first seat surface.

3. The photosensitive drum unit according to claim 2, wherein the first seat surface is a surface of a contact electrically connected to the elastic member.

4. The photosensitive drum unit according to claim 1, wherein a first end portion of the elastic member is configured to come in contact with the bearing member, wherein a position of the first end portion in the rotation direction of the photosensitive drum is restricted by a first position restriction portion provided in the bearing member, wherein a second end portion of the elastic member opposite to the first end portion of the elastic member is configured to come in contact with the seat surface, wherein a position of the second end portion in the rotation direction of the photosensitive drum is restricted by a second position restriction portion provided in the seat surface, and wherein the first end portion of the elastic member is disposed downstream of the second end portion of the elastic member in the rotation direction of the photosensitive drum.

5. The photosensitive drum unit according to claim 1, wherein the roller is rotated by rotation of the photosensitive drum.

6. The photosensitive drum unit according to claim 1, wherein the photosensitive drum includes, on the other end side of the photosensitive drum in the rotational axis direction of the roller, a driving force receiving portion configured to receive driving force that rotates the photosensitive drum.

7. The photosensitive drum unit according to claim 1, wherein the roller is a charge roller configured to receive applied voltage to charge the photosensitive drum.

* * * * *